US011513460B2

(12) United States Patent
Ooba

(10) Patent No.: US 11,513,460 B2
(45) Date of Patent: Nov. 29, 2022

(54) IMAGE FORMING APPARATUS AND METHOD OF SETTING PARAMETER IN IMAGE FORMING APPARATUS

(71) Applicant: Canon Kabushiki Kaisha, Tokyo (JP)

(72) Inventor: Hideaki Ooba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/188,369

(22) Filed: Mar. 1, 2021

(65) Prior Publication Data

US 2021/0181664 A1 Jun. 17, 2021

Related U.S. Application Data

(63) Continuation of application No. 15/847,066, filed on Dec. 19, 2017, now Pat. No. 10,976,692.

(30) Foreign Application Priority Data

Dec. 28, 2016 (JP) ..... JP2016-256767

(51) Int. Cl.
*G03G 15/00* (2006.01)

(52) U.S. Cl.
CPC ..... *G03G 15/5016* (2013.01); *G03G 15/502* (2013.01); *G03G 15/55* (2013.01); *G03G 15/6561* (2013.01); *G03G 15/6588* (2013.01); *G03G 15/5029* (2013.01); *G03G 15/6508* (2013.01); *G03G 2215/00569* (2013.01)

(58) Field of Classification Search
CPC .. G03G 15/5016; G03G 15/55; G03G 15/502; G03G 15/6588; G03G 15/6561; G03G 15/6508; G03G 2215/00569; G03G 15/5029
See application file for complete search history.

(56) References Cited

U.S. PATENT DOCUMENTS

| | | | | |
|---|---|---|---|---|
| 9,195,179 | B2 | 11/2015 | Shimizu et al. | |
| 2004/0246519 | A1* | 12/2004 | Hooper, III | G03G 15/2039 358/1.15 |
| 2007/0165248 | A1 | 7/2007 | Utsunomiya | |
| 2007/0264039 | A1 | 11/2007 | Saito et al. | |
| 2007/0279673 | A1 | 12/2007 | Utsunomiya | |
| 2008/0024807 | A1* | 1/2008 | Matsuda | G03G 15/6582 358/1.12 |

(Continued)

FOREIGN PATENT DOCUMENTS

| | | | |
|---|---|---|---|
| JP | H11-212424 | A | 8/1999 |
| JP | 2001-337564 | A | 12/2001 |

(Continued)

*Primary Examiner* — Benjamin R Schmitt
(74) *Attorney, Agent, or Firm* — Venable LLP

(57) ABSTRACT

When sheets having the same surface property and grammage are registered on a size basis, adjustment value registration operations need to be repeated for the respective sheets as many as these sizes. An image forming apparatus that includes a display unit and forms an image on a sheet sets a setting value of adjustment influenced by the characteristics of the image forming apparatus upon forming an image by using a sheet, and then displays a sheet list which displays a list of a plurality of types of sheets on a display unit and reflects the set setting value on at least one sheet selected from the sheet list.

16 Claims, 25 Drawing Sheets

(56) References Cited

U.S. PATENT DOCUMENTS

| | | | | |
|---|---|---|---|---|
| 2009/0252511 | A1* | 10/2009 | Watanabe | G03G 15/50 399/45 |
| 2010/0196035 | A1 | 8/2010 | Takemura | |
| 2012/0236333 | A1 | 9/2012 | Kiuchi et al. | |
| 2013/0195483 | A1 | 8/2013 | Shimizu et al. | |
| 2014/0029055 | A1* | 1/2014 | Shimura | G06K 15/40 358/1.16 |
| 2014/0160524 | A1* | 6/2014 | Anno | G03G 15/502 358/1.15 |
| 2014/0368862 | A1 | 12/2014 | Ooba | |

FOREIGN PATENT DOCUMENTS

| | | | |
|---|---|---|---|
| JP | 2006-053284 | A | 2/2006 |
| JP | 2006-276476 | A | 10/2006 |
| JP | 2010-072235 | A | 4/2010 |
| JP | 2010-175968 | A | 8/2010 |
| JP | 2013-174875 | A | 9/2013 |
| JP | 2014021473 | A | 2/2014 |
| JP | 2014-113724 | A | 6/2014 |
| JP | 2016175253 | A | 10/2016 |
| JP | 2018-049510 | A | 3/2018 |

* cited by examiner

IMAGE FORMING APPARATUS AND METHOD OF SETTING PARAMETER IN IMAGE FORMING APPARATUS

CROSS-REFERENCE TO RELATED APPLICATIONS

This application is a Continuation of U.S. patent application Ser. No. 15/847,066, filed Dec. 19, 2017, which claims priority to Japanese Patent Application No. 2016-256767, filed Dec. 28, 2016, the entire disclosures of which are both hereby incorporated by reference herein.

BACKGROUND OF THE INVENTION

Field of the Invention

The present invention relates to an image forming apparatus and a method of setting a parameter in the image forming apparatus.

Description of the Related Art

When printing by using a digital multi-function peripheral, various settings can be made on sheets used for the printing. It is possible to make, for example, a setting according to an attribute for each sheet such as the name, grammage, or surface property of the sheet, a setting influenced by the characteristics of the digital multi-function peripheral (for example, a voltage value when an image is transferred to the sheet) upon printing on the sheet, or the like. An operator who uses the digital multi-function peripheral can obtain a printed product that he/she desires by printing while making these setting values be optimal values. Accordingly, an operation for setting these setting values is essential to obtain the desired printed product, and a mechanism for enhancing this operability is considered.

Japanese Patent Laid-Open No. H11-212424 describes a technique of, when test print is executed in order to confirm whether image alignment is adjusted correctly after this adjustment is performed, selecting a sheet feed tray automatically in accordance with the adjustment operation.

In the above related art, although operability in the test print after execution of the adjustment operation is improved, no consideration is given to reflect an adjustment value resulting from the performed adjustment on a plurality of types of sheets when it is reflected on sheet information in the first place. In the above related art, a sheet is selected first, then image alignment is adjusted, test print is executed, and this adjustment value is reflected on the sheet selected and fed from the sheet feed tray. In this processing, when a user wants to perform the same adjustment on the plurality of types of sheets, he/she needs to perform operations for setting adjustment values as many as the types of sheets to be adjusted.

This increases the number of times the user needs to perform the operations, impairing user convenience.

For example, adjustment of a secondary transfer voltage will be described as an example of a case in which the same setting is to be performed on the plurality of types of sheets. Adjustment of the secondary transfer voltage is a function of adjusting a voltage when a toner image is transferred from a transfer belt to a sheet. With this adjustment, it is possible to set an appropriate value in accordance with the grammage or surface property of the sheet and obtain a product desired by the user. Therefore, when sheets having the same surface property and grammage are registered on a size basis, registration operations need to be repeated as many as these sizes. More specifically, for example, when the sheets having the same surface property and grammage are registered with four sizes, namely, A4, A3, B4, and B5, adjustment values need to be set four times in total on the size basis. As a result, user convenience is impaired, and productivity cannot be increased by using a multi-function peripheral.

SUMMARY OF THE INVENTION

An aspect of the present invention is to eliminate the above-mentioned problem with conventional technology.

A feature of the present invention is to provide a technique capable of setting adjustment values regarding image formation simultaneously on a plurality of types of sheets.

According to a first aspect of the present invention, there is provided an image forming apparatus capable of setting a parameter used for image formation for each sheet, the apparatus comprising: one or more controller having a processor for executing a program or a circuit on which a predetermined function is implemented, wherein the controller configured to function as: an acceptance unit configured to accept an input of a specific parameter to a registration sheet; a first display unit configured to display a list of a plurality of registration sheets on a display unit; a selection unit configured to make a user select a first registration sheet and a second registration sheet from the list of the plurality of registration sheets displayed on the display unit; a storage unit configured to store the specific parameter in association with the selected first registration sheet and store the specific parameter in association with the selected second registration sheet; and a control unit configured to control, based on the specific parameter stored in association with a sheet on which image formation is performed, image formation on the sheet.

According to a second aspect of the present invention, there is provided a method of setting a parameter in an image forming apparatus capable of setting a parameter used for image formation for each sheet, the method comprising: accepting an input of a specific parameter to a registration sheet; displaying a list of a plurality of registration sheets on a display unit; making a user select a first registration sheet and a second registration sheet from the list of the plurality of registration sheets displayed on the display unit; and storing the specific parameter in association with the selected first registration sheet and storing the specific parameter in association with the selected second registration sheet.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

First Embodiment

Figure 1:
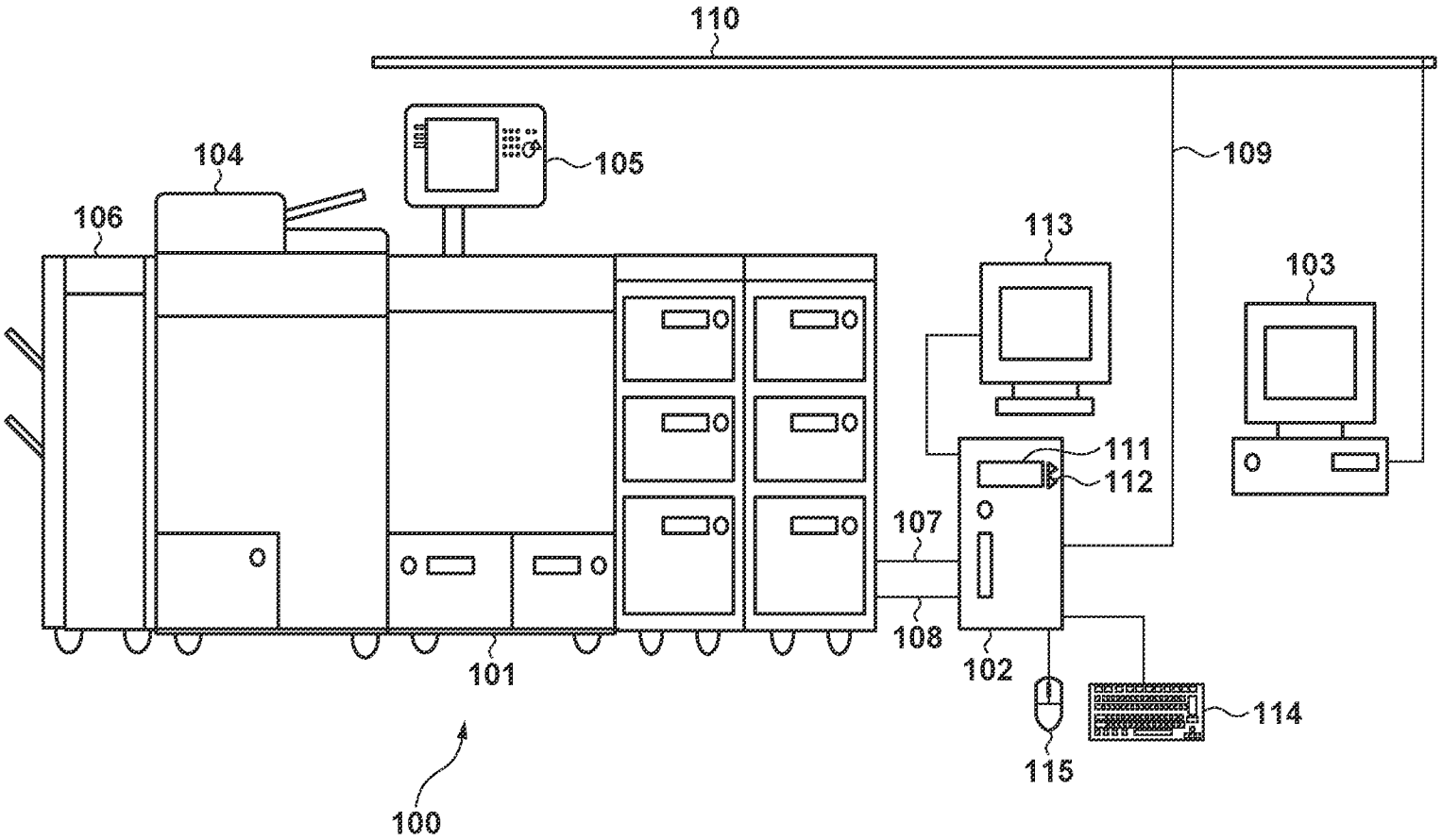
FIG. 1 depicts a view for explaining the overall arrangement of a printing system according to a first embodiment of the present invention.

FIG. 1 depicts a view for explaining the overall arrangement of a printing system 100 according to the first embodiment of the present invention.

This printing system 100 includes an image forming apparatus 101 and a print control apparatus 102. Then, this printing system 100 is connected to a client computer 103 to be able to communicate with each other. The client computer 103 and the print control apparatus 102 are connected to be able to communicate with each other via a Local Area Network (LAN) 110 by using an Ethernet® cable 109. The print control apparatus 102 and the image forming apparatus 101 are connected via a video cable 107 and a control cable 108. In the first embodiment, the image forming apparatus 101 is not connected to the LAN 110 directly and communicates with the client computer 103 via the print control apparatus 102. Note that the image forming apparatus 101 may be connected to the LAN 110 directly. That is, the image forming apparatus 101 may be connected to the client computer 103 directly to be able to communicate with each other. The client computer 103 activates an application to give a print instruction or the like to the printing system 100. The print control apparatus 102 performs image processing in cooperation with the image forming apparatus 101.

The image forming apparatus 101 is a multi-function peripheral having various functions such as a print function, a scan function, a facsimile function, and the like. This image forming apparatus 101 can not only perform image processing on image data received from the client computer 103 or the print control apparatus 102 but also print image data obtained by reading an original with a scanner unit 104 or transmit it to a shared folder. When the original is read with the scanner unit 104, various instructions are accepted from a user via a console unit 105. A display unit of the console unit 105 displays various kinds of information such as information on the scan status of the scanner unit 104. A finisher 106 receives a sheet with a printed image and performs post processing such as bookbinding on the sheet.

A display unit 111 of the print control apparatus 102 displays information on the print control apparatus 102. The user operates an operation button 112 of the print control apparatus 102 to operate the information displayed on the display unit 111. The information displayed on the display unit 111 is used to display the minimum information (a power supply operation, an IP address confirmation, or the like) required to operate the print control apparatus 102. An external display unit 113 of the print control apparatus 102 is a display unit such as a liquid crystal monitor. The print control apparatus 102 is connected to a keyboard 114 and a pointing device 115 as user interfaces.

In the first embodiment, the printing system 100 will be described assuming that the print control apparatus 102 and the image forming apparatus 101 are separate systems. However, the functions of the print control apparatus 102 may be included inside the image forming apparatus 101, and the print control apparatus 102 may not be arranged physically. An arrangement may be possible in which the display unit 113 has a touch panel function and also functions as the pointing device 115.

Figure 2:
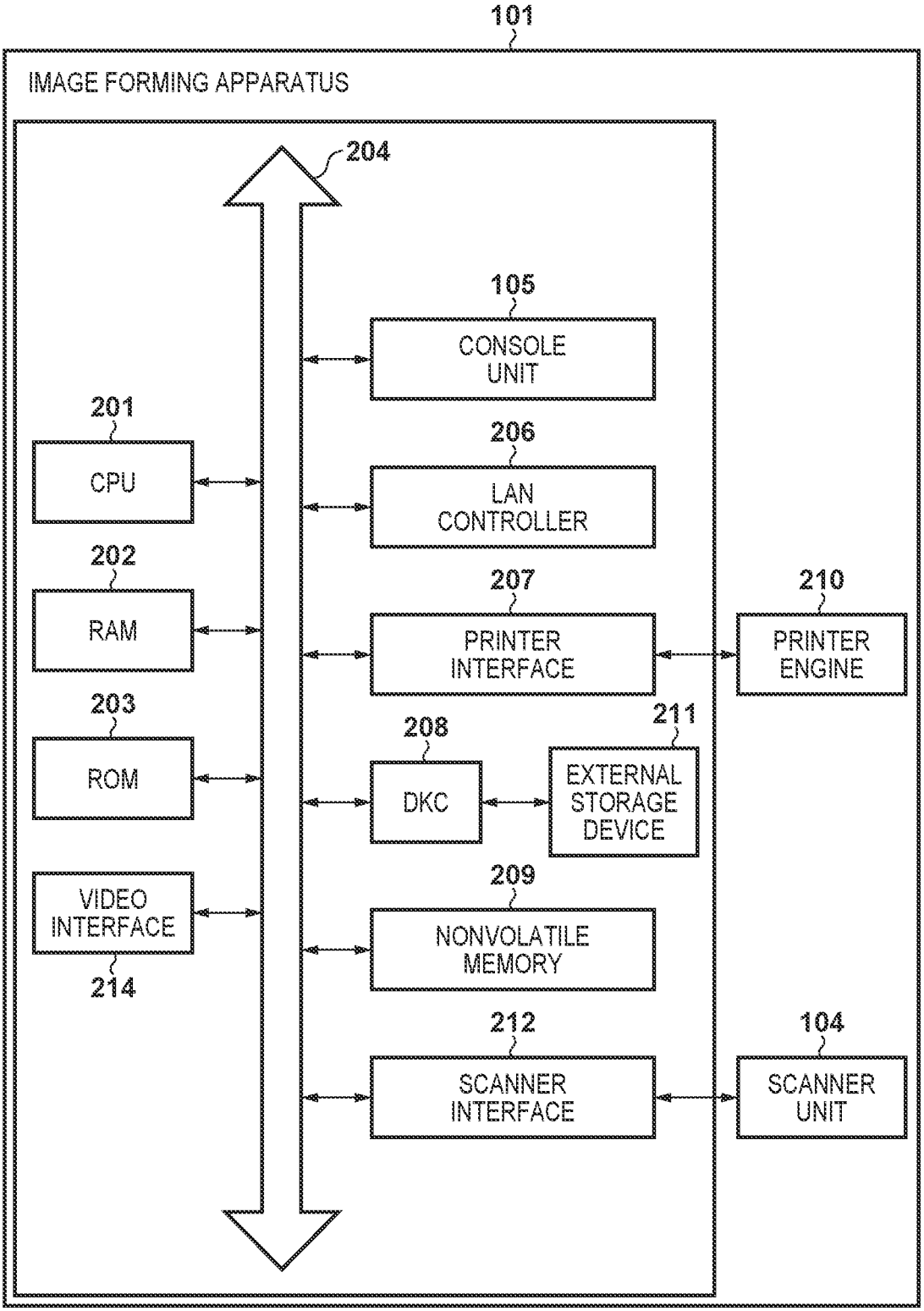
FIG. 2 is a block diagram for explaining the hardware arrangement of an image forming apparatus according to the first embodiment.

FIG. 2 is a block diagram for explaining the hardware arrangement of the image forming apparatus 101 according to the first embodiment.

A CPU 201 executes a boot program stored in a ROM 203 to deploy a control program stored in an external storage device 211 to a RAM 202 and executes it, thereby generally controlling the respective devices connected to a system bus 204. The CPU 201 also outputs an image signal as print information to a printing unit (printer engine) 210 connected via a printer interface 207 or receives an image signal which is input from the scanner unit 104 connected via a reading interface 212. The printer engine 210 forms (prints) an image by an electrophotographic method. The CPU 201 can also communicate with the print control apparatus 102 via a LAN controller 206. The RAM 202 mainly functions as the main memory, work area, or the like of the CPU 201. Access to the external storage device 211 such as a hard disk (HDD) or an IC card is controlled by a disk controller (DKC) 208. The external storage device 211 is used as a job storage area for storing an application program, font data, form data, and the like or spooling a print job temporarily and externally controlling the spooled job. The external storage device 211 is further used as a BOX data storage area for holding image data obtained by reading with the scanner unit 104 or image data of the print job as BOX data, referring it from a network, and printing. In the first embodiment, the HDD is used as the external storage device 211, and various logs such as a job log and an image log are held. The console unit 105 allows the user to input various kinds of information via a software key or a hardware key. In addition, a display unit (not shown) of the console unit 105 has a touch panel function, and the various kinds of information are presented to the user via this display unit. A nonvolatile memory 209 stores various kinds of setting information set via the console unit 105 or the LAN 110. A video interface 214 receives image data from the print control apparatus 102.

Figure 3:
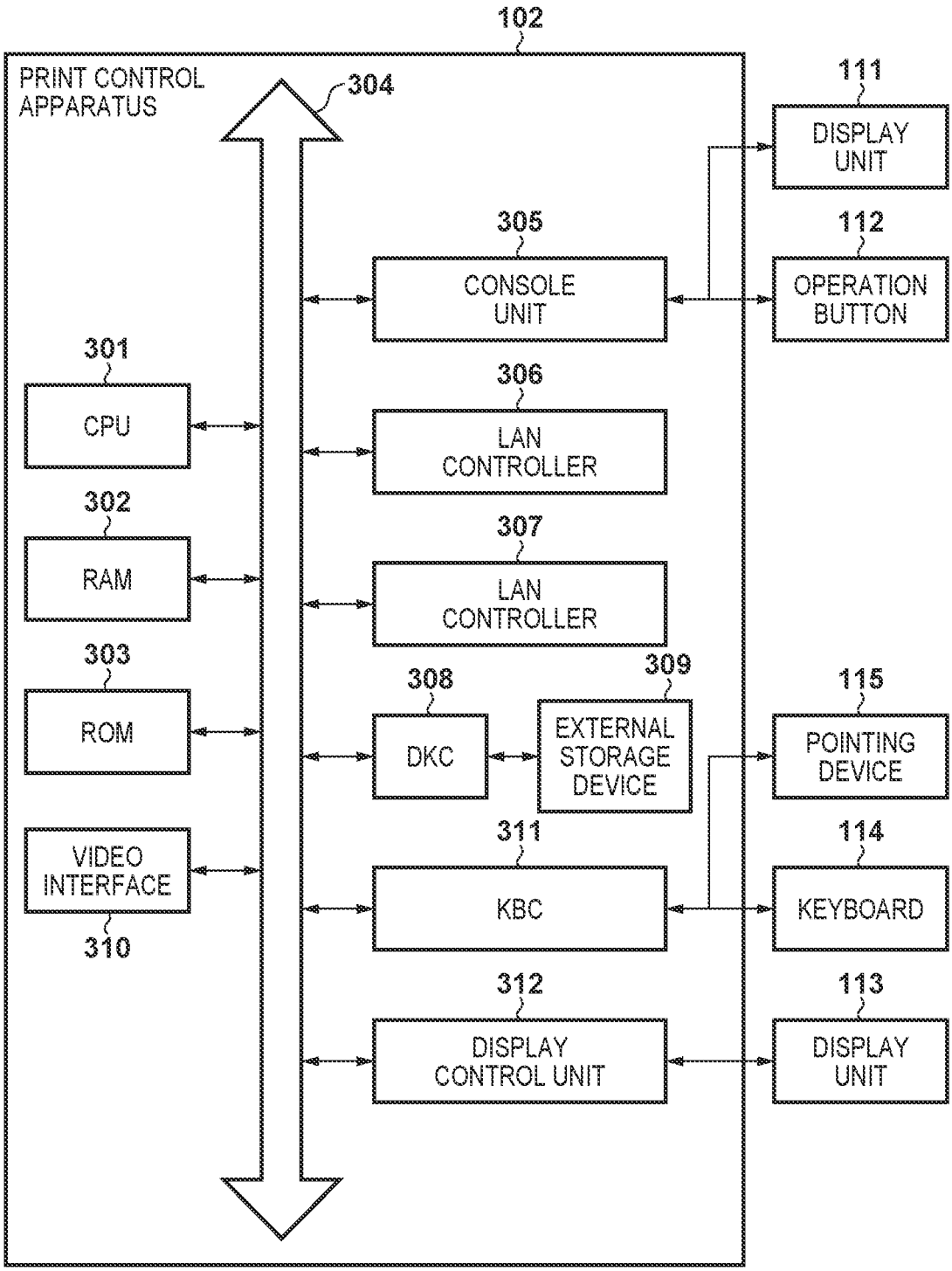
FIG. 3 is a block diagram for explaining the hardware arrangement of a print control apparatus according to the first embodiment.

FIG. 3 is a block diagram for explaining the hardware arrangement of the print control apparatus 102 according to the first embodiment.

A CPU 301 executes a boot program stored in a ROM 303 to deploy a control program stored in an external storage device 309 to a RAM 302 and executes it, thereby generally controlling the respective units connected to a system bus 304. The CPU 301 can also communicate with the image forming apparatus 101 via a LAN controller 306. The CPU 301 can also communicate with the image forming apparatus 101 or the client computer 103 on the LAN 110 via a LAN controller 307. The RAM 302 mainly functions as the main memory, work area, or the like of the CPU 301. Access to the external storage device 309 such as a hard disk (HDD) or an IC card is controlled by a disk controller (DKC) 308. The external storage device 309 stores an application program, font data, form data, and the like or spools a print job temporarily. The spooled job is processed by a RIP (Raster Image Processor) and saved in the external storage device 309 again. The console unit 305 receives various kinds of information input by the user via the operation button 112 and outputs them to the system bus 304, and also outputs/displays the information received from the system bus 304 to/on the display unit 111. A video interface 310 is used to transmit image data that has undergone RIP processing to the image forming apparatus 101. A keyboard controller (KBC) 311 performs processing associated with the input of information from the keyboard 114 and the pointing device 115 such as a mouse®. A display control unit 312 includes a video memory inside, draws image data in the video memory in accordance with an instruction from the CPU 301, and outputs/displays the image data drawn in the video memory to/on the display unit 113 as a video signal.

Figure 4A:
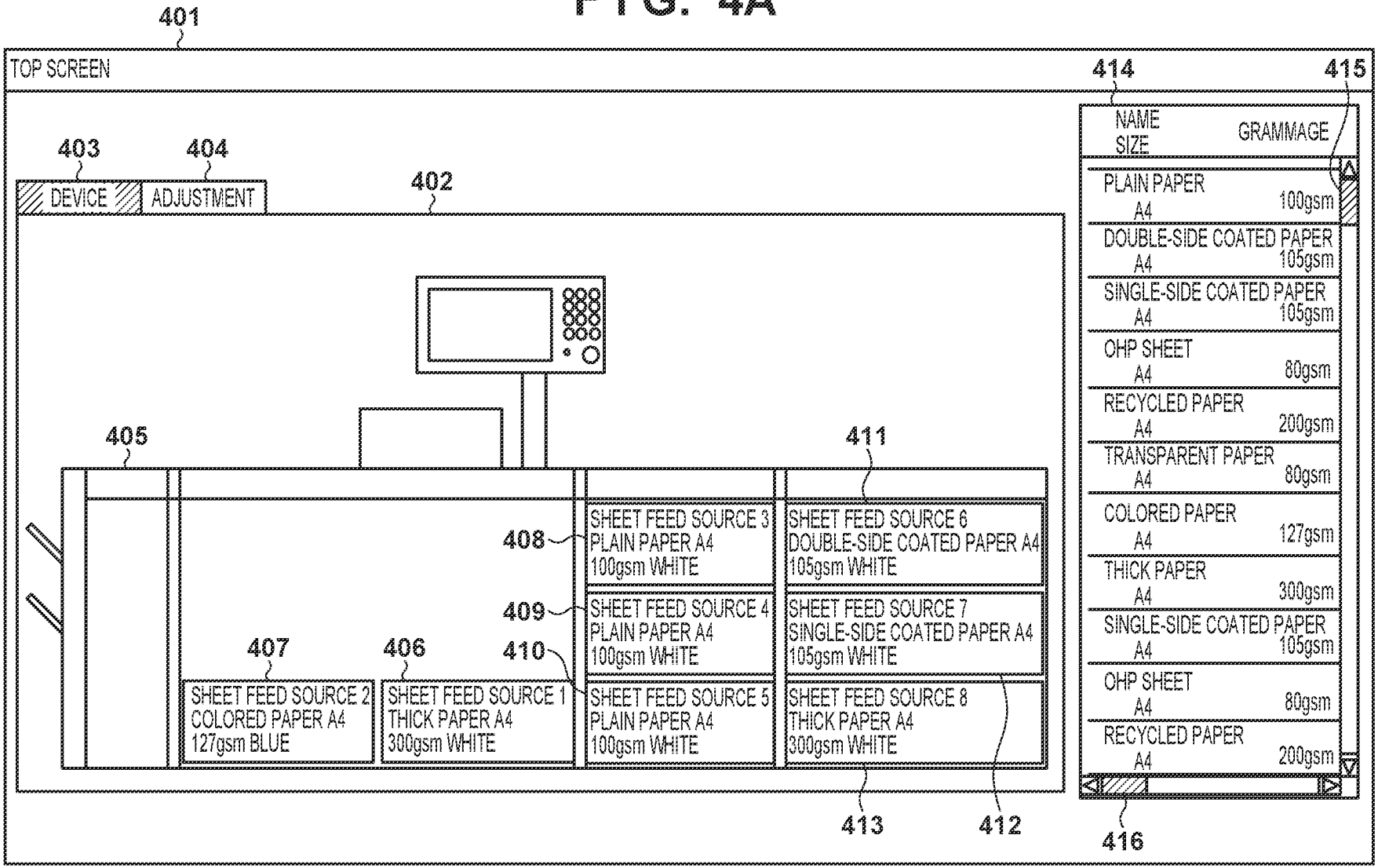
FIGS. 4A and 4B depict views each showing an example of a screen displayed by a sheet management application that operates on the print control apparatus according to the first embodiment.
Figure 4B:
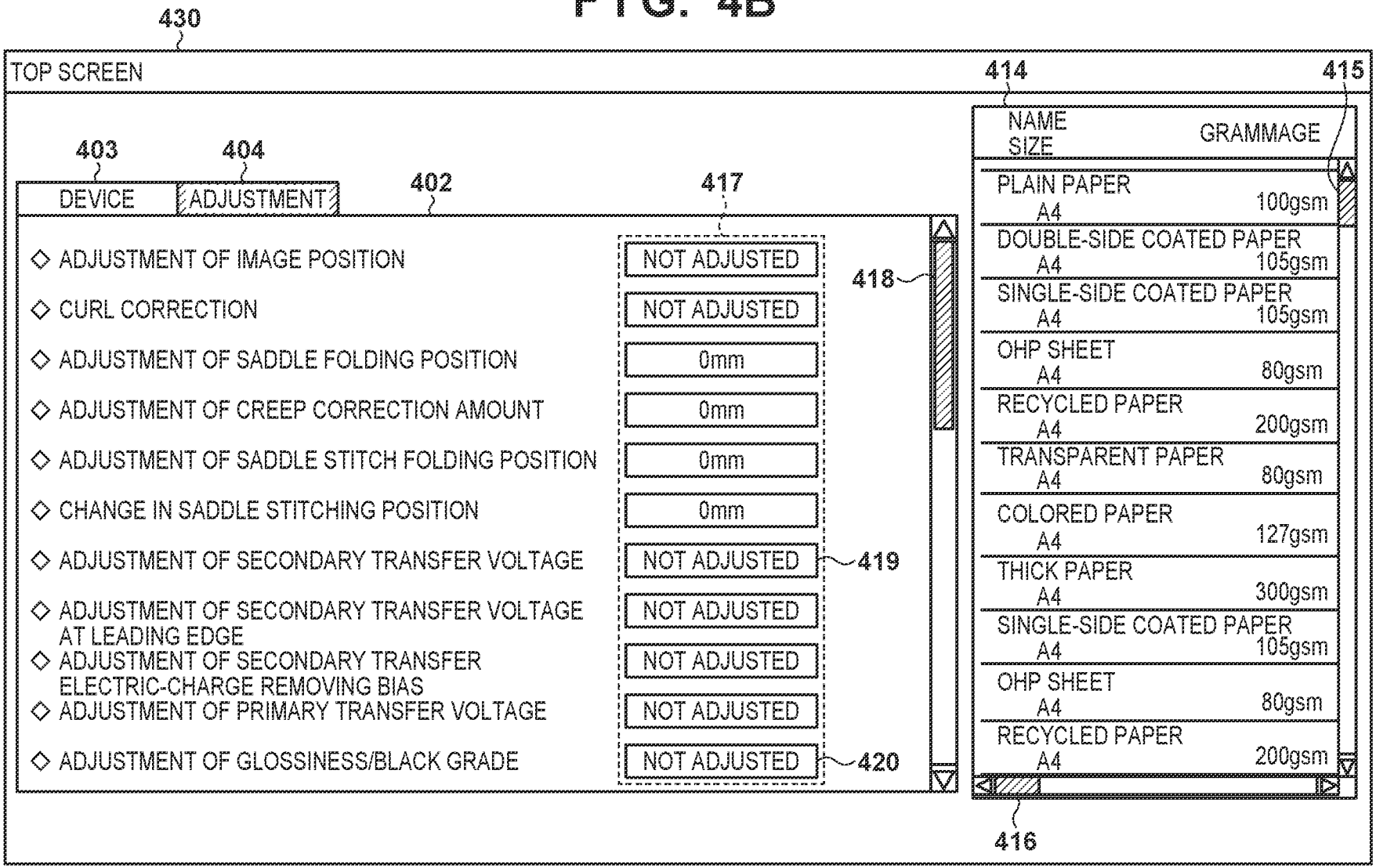

FIGS. 4A and 4B depict views each showing an example of a screen displayed by a sheet management application that operates on the print control apparatus 102 according to the first embodiment. FIG. 4A shows the example of the screen on which information on a sheet feed source (sheet feed unit) of the image forming apparatus 101 is displayed. FIG. 4B shows the example of the screen on which buttons capable of executing various adjustment settings of the image forming apparatus 101 are displayed.

A top screen of the sheet management application draws image data in its video memory in accordance with an instruction from the CPU 301, and is output/displayed to/on the display unit 113 by using the image data drawn in the video memory as a video signal.

A top screen 401 of the sheet management application shown in FIG. 4A includes a display area 402 capable of controlling tabs. FIG. 4A shows a screen in a state in which a device tab 403 is pressed, and sheet feed source information of the image forming apparatus 101 is displayed in the display area 402.

On the other hand, if an adjustment tab 404 is pressed, a screen in a state in which the buttons capable of executing the various adjustment settings are displayed in the display area 402 can be displayed, as shown in FIG. 4B.

A display area 405 of FIG. 4A displays the current connection states of the hardware options of the image forming apparatus 101 connected to the print control apparatus 102. When the sheet management application is activated, it obtains information on the hardware options from the image forming apparatus 101 and displays the connection states of the hardware options in accordance with this option information. FIG. 4A represents a state in which POD decks are multilinked, and a finisher is connected. Sheet feed source buttons 406 to 413 are operation buttons corresponding to respective sheet feed sources. These sheet feed source buttons 406 to 413 are created and arranged based on the sheet feed source information of the image forming apparatus 101 obtained when the sheet management application is activated. Sheet information 414 displays information on sheets that can be loaded in the sheet feed sources of the image forming apparatus 101. Attribute information of a sheet and the grammage of the sheet are displayed in each row of the sheet information 414. If the user wants to scroll the displayed sheet attribute information, he/she can display the information by operating a slider bar 415. If the user wants to display sheet information other than the displayed sheet information, he/she can display other sheet information by operating a slider bar 416.

A top screen 430 of the sheet management application shown in FIG. 4B includes buttons 417 capable of setting various adjustment values in correspondence with various adjustment functions. Adjustment items that can be executed by this image forming apparatus 101 are displayed here. It is possible to display and confirm adjustment items that are not displayed currently by scanning a slider bar 418. A secondary transfer voltage adjustment button 419 and a glossiness/black grade adjustment button 420 will be described in detail later.

Figure 5:
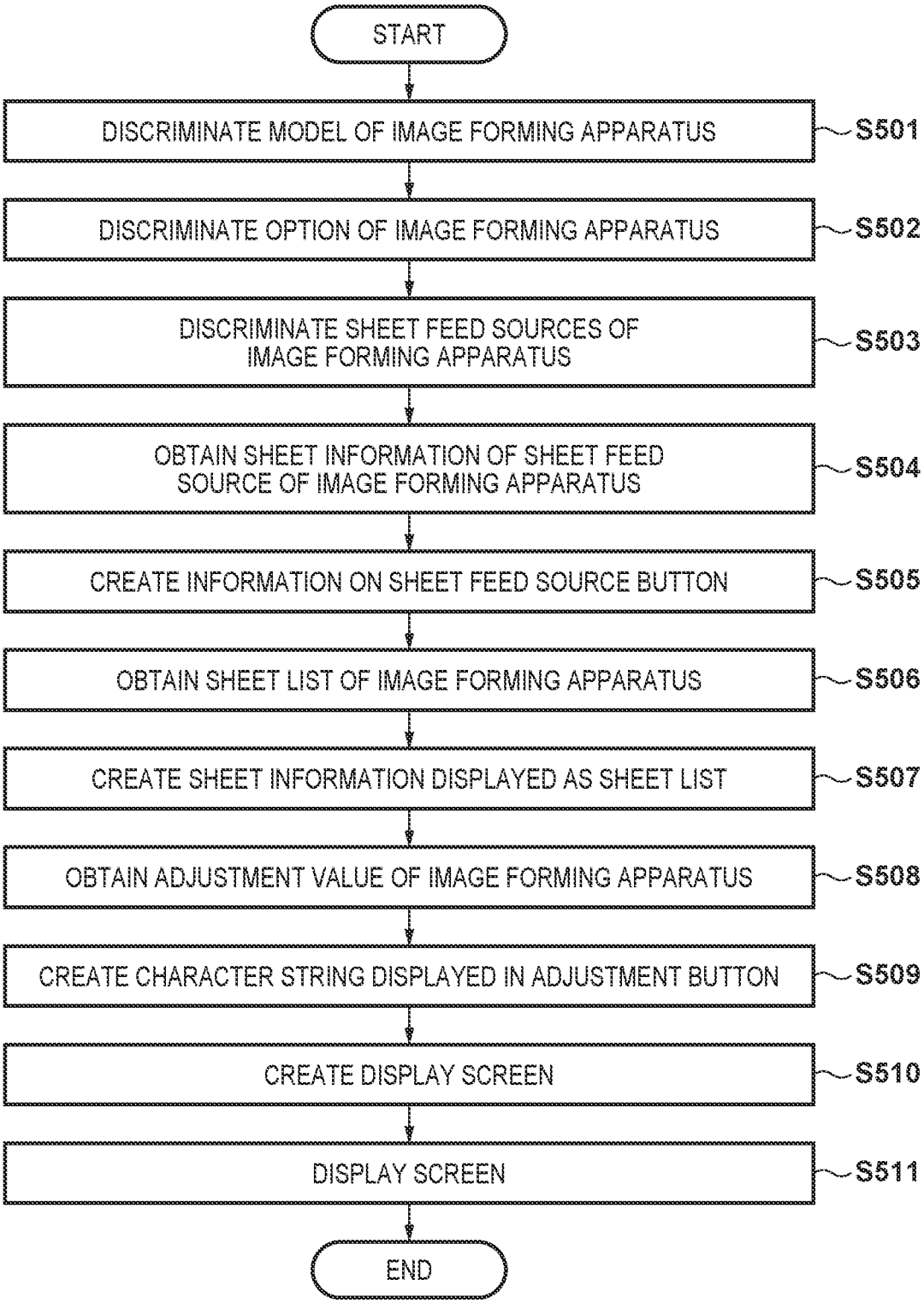
FIG. 5 is a flowchart for describing a process when the print control apparatus displays a top screen of the sheet management application shown in FIG. 4 according to the first embodiment.

FIG. 5 is a flowchart for describing a process when the print control apparatus 102 displays the top screens of the sheet management application shown in FIGS. 4A and 4B according to the first embodiment. Note that the process shown in this flowchart is achieved by causing the CPU 301 to deploy a sheet management application program stored in the external storage device 309 to the RAM 302 and execute it.

When this sheet management application is activated, in step S501, the CPU 301 discriminates the model of the image forming apparatus 101 serving as a sheet management target. Then, the CPU 301 discriminates the model of the image forming apparatus 101 and refers to this discriminated model when creating the display area 405 showing the hardware options in FIG. 4A and when absorbing a specification difference between models. At this time, the CPU 301 communicates with the image forming apparatus 101 to obtain model information and discriminates the model of the image forming apparatus 101 based on the obtained model information and model information held in advance. Next, the process advances to step S502 in which the CPU 301 discriminates a hardware option connected to the image forming apparatus 101. Then, the CPU 301 refers to this discriminated hardware option when creating a hardware option screen, when specifying sheet feed source information, or when absorbing the specification difference between the models.

Next, the process advances to step S503 in which the CPU 301 discriminates sheet feed sources connected to the image forming apparatus 101 serving as the sheet management target and specifies the number of connected sheet feed sources. Next, the process advances to step S504 in which the CPU 301 communicates with the image forming apparatus 101 and obtains sheet information set in each of the connected sheet feed sources. Then, the process advances to step S505 in which the CPU 301 creates information on, for example, the sheet feed source buttons 406 to 413 displayed on the top screen 401 shown in FIG. 4A. Then, the process advances to step S506 in which the CPU 301 communicates with the image forming apparatus 101, and obtains a sheet list displayed in the sheet information 414 of FIGS. 4A and 4B. Next, the process advances to step S507 in which the CPU 301 creates information on, for example, the sheet information 414 displayed as in FIGS. 4A and 4B, and the process advances to step S508.

In step S508, the CPU 301 communicates with the image forming apparatus 101 and obtains the adjustment value for each adjustment in order to display it in the adjustment buttons 417 of FIG. 4B.

Then, the process advances to step S509. In step S509, based on the adjustment values obtained in step S508, the CPU 301 creates character strings set in the adjustment buttons 417. If there is only one adjustment value, the value is displayed. If there are two or more adjustment values, the presence/absence of adjustment is displayed. Then, the process advances to step S510 in which the CPU 301 creates, for example, the screens as shown in FIGS. 4A and 4B by using the model of the image forming apparatus 101, hardware option information, sheet feed source button information, sheet list information, and character strings of the adjustment buttons obtained in the above-described process. Then, the process advances to step S511 in which the CPU 301 outputs/displays the screen information to/on the display unit 113.

Figure 6:
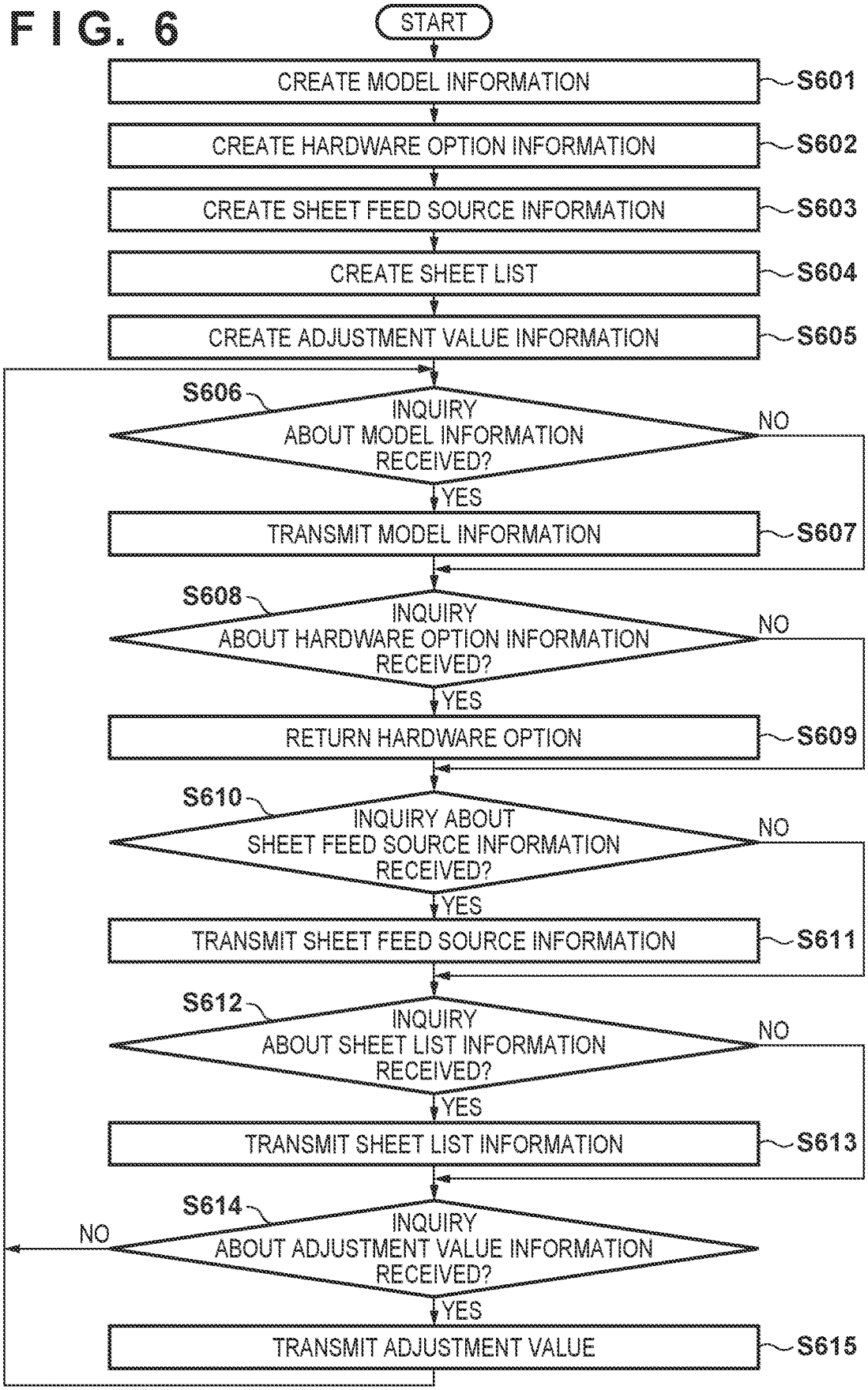
FIG. 6 is a flowchart for describing a process performed by the image forming apparatus according to the first embodiment in accordance with an operation of the print control apparatus shown in FIG. 5.

FIG. 6 is a flowchart for describing a process performed by the image forming apparatus 101 according to the first embodiment in accordance with the operation of the print control apparatus 102 shown in FIG. 5. Note that the process shown in this flowchart is achieved by causing the CPU 201 to deploy programs stored in the external storage device 211 to the RAM 202 and execute them.

First, in step S601, the CPU 201 obtains its own model information from the external storage device 211 and creates it as data that can be transmitted to the print control apparatus 102. Then, the process advances to step S602 in which the CPU 201 obtains information on the hardware options connected to the image forming apparatus 101 from the external storage device 211 and creates it as data that can be transmitted to the print control apparatus 102. Then, the process advances to step S603 in which the CPU 201 obtains sheet feed source information of the image forming apparatus 101 from the external storage device 211 and creates it as data that can be transmitted to the print control apparatus 102. Then, the process advances to step S604 in which the CPU 201 obtains the sheet list information of the image forming apparatus 101 from the external storage device 211 and creates it as data that can be transmitted to the print control apparatus 102. Next, the process advances to step S605 in which the CPU 201 obtains adjustment value information of the image forming apparatus 101 from the external storage device 211 and creates it as data that can be transmitted to the print control apparatus 102. Note that in step S605, the CPU 201 obtains adjustment values for all adjustment items that can be executed by the image forming apparatus 101.

Next, the process advances to step S606 in which the CPU 201 determines whether or not an inquiry about the model information is received from the print control apparatus 102. If the inquiry about the model information is received, the process advances to step S607 in which the model information created in step S601 is transmitted to the print control apparatus 102. Then, the process advances to step S608. The process also shifts to step S608 if the inquiry about the model information is not received in step S606. In step S608, the CPU 201 determines whether or not an inquiry about the hardware option information is received from the print control apparatus 102. If so, the process advances to step S609 in which the CPU 201 transmits the hardware option information created in step S602 to the print control apparatus 102 and the process advances to step S610. The process also shifts to step S610 if the inquiry about the hardware option information is not received in step S608. In step S610, the CPU 201 determines whether or not an inquiry about the sheet feed source information is received from the print control apparatus 102. If so, the process advances to step S611 in which the CPU 201 transmits the sheet feed source information created in step S603 to the print control apparatus 102 and the process advances to step S612. The process also shifts to step S612 if the inquiry about the sheet feed source information is not received in step S610. In step S612, the CPU 201 determines whether or not an inquiry about the sheet list information is received from the print control apparatus 102. If so, the process advances to step S613 in which the CPU 201 transmits the sheet list information created in step S604 to the print control apparatus 102. Then, the process advances to step S614. The process also shifts to step S614 if the inquiry about the sheet list information is not received in step S612. In step S614, the CPU 201 determines whether or not an inquiry about the adjustment value information is received from the print control apparatus 102. If so, the process advances to step S615 in which the adjustment value information created in step S605 is transmitted to the print control apparatus 102 and the process advances to step S606. The process also shifts to step S606 if the inquiry about the adjustment value information is not received in step S614.

With the above process, the print control apparatus 102 can display, for example, the screens as shown in FIGS. 4A and 4B on the display unit 113.

Figure 7:
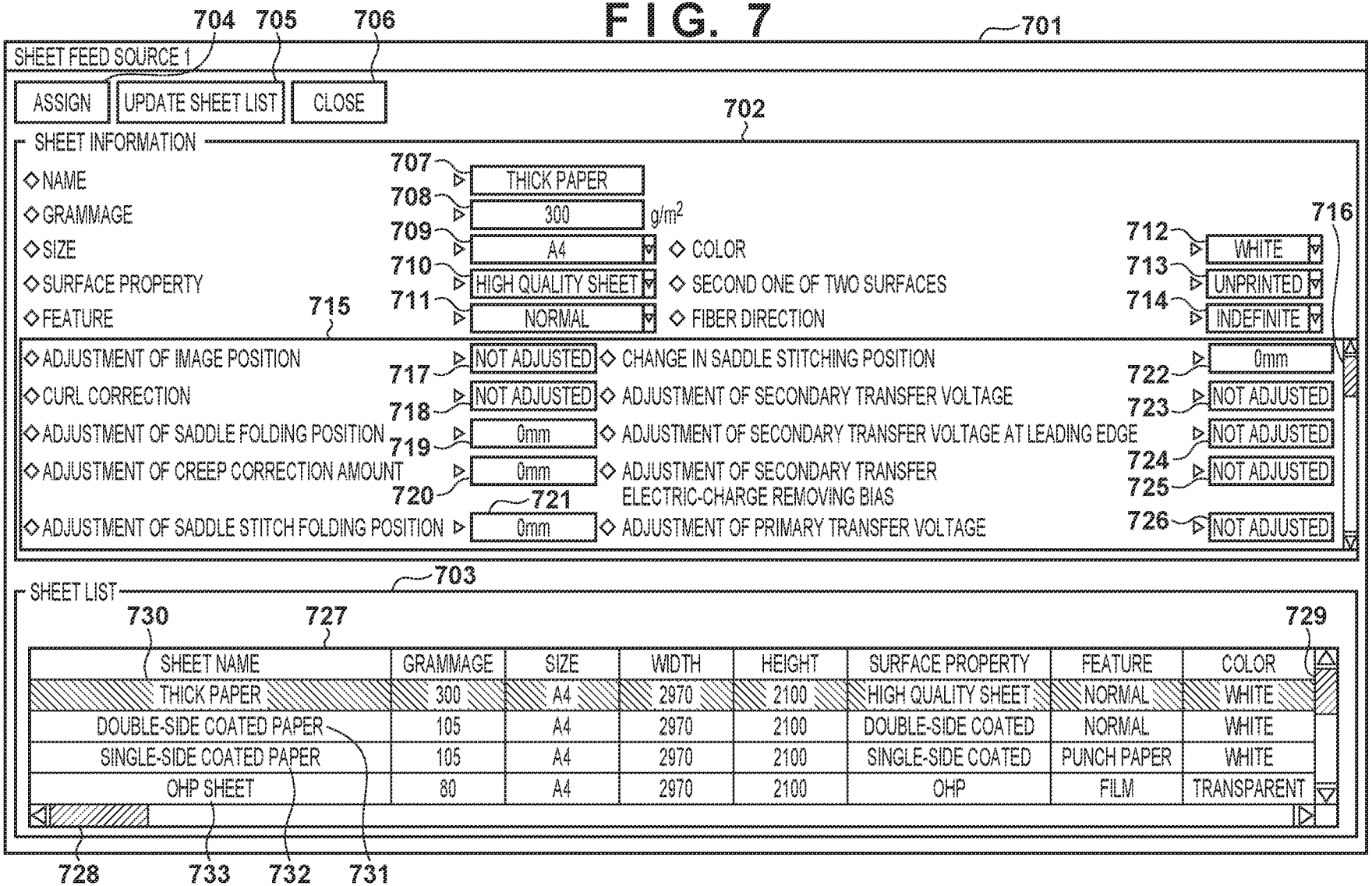
FIG. 7 depicts a view showing an example of a sheet setting screen of sheet feed source 1 displayed by the print control apparatus according to the first embodiment.

A description will be given referring back to FIG. 4A. If the sheet feed source button 406 of sheet feed source 1 is instructed by using the pointing device 115 or the like in FIG. 4A, for example, a sheet setting screen of sheet feed source 1 as shown in FIG. 7 is displayed. Note that screens are displayed, and processes are performed basically in the same manner as in the case of this button 406 if the other sheet feed source buttons 407 to 413 are instructed, and thus a description thereof will be omitted. The sheet feed sources include the various types of sheet feed devices such as an inserter and a manual feed tray, although not described in detail in the first embodiment. In a description below, a description that the pointing device 115 or the like is used when an application is operated, for example, when a button is pressed will be omitted. However, a button and the like are instructed by using a touch panel or such an input device.

FIG. 7 depicts a view showing an example of the sheet setting screen of sheet feed source 1 displayed by the print control apparatus 102 according to the first embodiment. Image data of the sheet setting screen of sheet feed source 1 is rendered in its video memory in accordance with an instruction from the CPU 301, and is output/displayed to/on the display unit 113 as a video signal to display the sheet setting screen.

On a top screen 701 of a screen for sheet feed source 1, a sheet information display area 702, a sheet list display area 703, an assignment button 704, a sheet list update button 705, and a close button 706 are displayed. The sheet information display area 702 displays setting information of a currently selected sheet. When the sheet feed source button 406 of FIG. 4A is pressed, and the screen 701 is displayed, information on a sheet that is currently assigned to sheet feed source 1 is displayed. In the sheet list display area 703, a list of sheet information managed by the print control apparatus 102 and image forming apparatus 101 is displayed. When the user selects a sheet from this sheet list display area 703, information on the selected sheet is displayed in the sheet information display area 702. FIG. 7 shows a state in which "thick paper" is selected.

First, each input item in the sheet information display area 702 will be described.

A sheet name can be input to a text field 707. When the name is changed, it can be changed by entering characters directly in this text field 707 by using the keyboard 114 or the like. In a description below, a description that the keyboard 114 or the like is used at the time of an entry will be omitted. However, characters are also entered by using such an input device in the description below. Then, the sheet list update button 705 is pressed in order to reflect changed information in sheet information. If the sheet list update button 705 is pressed, the sheet information of the print control apparatus 102 and image forming apparatus 101 can be changed. Grammage can be input to a text field 708. An operation in this case is the same as in the case of the text field 707, and thus a description thereof will be omitted. A combo box 709 that displays sheet size information can select a desired sheet size from listed sheet size information and set it. In order to reflect the changed information in the sheet information, the sheet list update button 705 is pressed. It is possible to change the sheet information of the print control apparatus 102 and image forming apparatus 101 by pressing the sheet list update button 705. A combo box 710 displays sheet surface property information. Note that an operation using each combo box below is basically the same as in the case of the size combo box 709, and thus a description thereof will be omitted. A combo box 711 displays sheet feature information. A combo box 712 displays sheet color information. A combo box 713 displays information on the second one of both sides of a sheet. A combo box 714 displays information on the fiber direction of a sheet.

In an area 715 where settings of adjustment values are displayed together, many setting items related to adjustment exist, and thus all of them cannot be accommodated in this screen. When an adjustment setting item that is not currently displayed is confirmed, it is possible to display a setting value that is not displayed currently by operating a slider bar 716. A setting item button 717 for adjustment of an image position displays whether a current sheet has already undergone image position adjustment. If the sheet has already undergone the image position adjustment, "adjusted" is displayed. If the sheet has not undergone the image position adjustment, "not adjusted" is displayed. An adjustment screen is opened by pressing the setting item button 717 for adjustment of the image position, and various adjustment values can be input on this adjustment screen. In order to reflect the changed information in the sheet information, the sheet list update button 705 is pressed. If the sheet list update button 705 is pressed, the sheet information of the print control apparatus 102 and image forming apparatus 101 can be changed.

The operation of a setting item button 718 for curl correction is basically the same as the setting item button 717 for adjustment of the image position, and thus a description thereof will be omitted. A setting item button 719 for adjustment of a saddle folding position displays a current adjustment value in units of mm. An adjustment screen is opened by pressing the setting item button 719 for adjustment of the saddle folding position, and various adjustment values can be input on this adjustment screen. In order to reflect the changed information in the sheet information, the sheet list update button 705 is pressed. This makes it possible to change the sheet information of the print control apparatus 102 and image forming apparatus 101. The operation of a setting item button 720 for adjustment of a creep correction amount is basically the same as the setting item button 719 for adjustment of the saddle folding position, and thus a description thereof will be omitted. The operation of a setting item button 721 for adjustment of a saddle stitch folding position is basically the same as in the case of the setting item button 719 for adjustment of the saddle folding position, and thus a description thereof will be omitted. In addition, the operation of a setting item button 722 for adjustment of a saddle stitching position is basically the same as the setting item button 719 for adjustment of the saddle folding position, and thus a description thereof will be omitted. The operation of a setting item button 723 for adjustment of a secondary transfer voltage is basically the same as in the case of the setting item button 717 for adjustment of the image position, and thus a description thereof will be omitted. The operation of a setting item button 724 for adjustment of a secondary transfer voltage at a leading edge is basically the same as in the case of the setting item button 717 for adjustment of the image position, and thus a description thereof will be omitted. The operation of a setting item button 725 for adjustment of a secondary transfer electric-charge removing bias is basically the same as the setting item button 717 for adjustment of the image position, and thus a description thereof will be omitted. The operation of a setting item button 726 for adjustment of a primary transfer voltage is basically the same as in the case of the setting item button 717 for adjustment of the image position, and thus a description thereof will be omitted.

The sheet list display area 703 will now be described. In a table 727 where the sheet list is displayed, sheet attribute information is displayed in each column, and a sheet name is displayed in each row. If the user wants to display sheet attribute information other than the sheet attribute information displayed here, it can be displayed by operating a slider bar 728. In addition, if the user wants to display a sheet other than the displayed sheets, it can be displayed by operating a slider bar 729. A sheet 730 indicates a sheet displayed in the sheet information display area 702 and is highlighted so as to be seen that it is selected. Sheets 731 to 733 indicate sheets that are not displayed in the sheet information display area 702. If one of the unselected sheets 731 to 733 is selected in this table 727, information on a newly selected sheet is displayed in the sheet information display area 702. By pressing the assignment button 704 in this state, it is possible to assign the newly selected sheet to selected sheet feed source 1. If the screen is ended without any change, the close button 706 is pressed.

With the above-described process, it is possible, by selecting a sheet feed source on the screen of FIG. 4A, to assign a desired sheet to the selected sheet feed source. It is also possible to display whether various adjustment operations such as adjustment of the image position has been performed on the sheet assigned to the sheet feed source, and it is further possible to change the adjustment value. Furthermore, at this time, it is possible to select a plurality of types of sheets simultaneously and to set various adjustment values to all the selected plurality of types of sheets in the same manner.

A description will be given referring back to FIG. 4B. An example of the settings of the adjustment values shown in FIG. 4B will be described by using the secondary transfer voltage adjustment button 419.

This secondary transfer voltage adjustment button 419 processes in the same manner as in a case in which the button 723 of FIG. 7 is pressed. If a sheet is selected from the sheet information 414, and the secondary transfer voltage adjustment button 419 is pressed in FIG. 4B, a secondary transfer voltage adjustment screen shown in FIG. 8 is displayed on the display unit 113.

Figure 8:
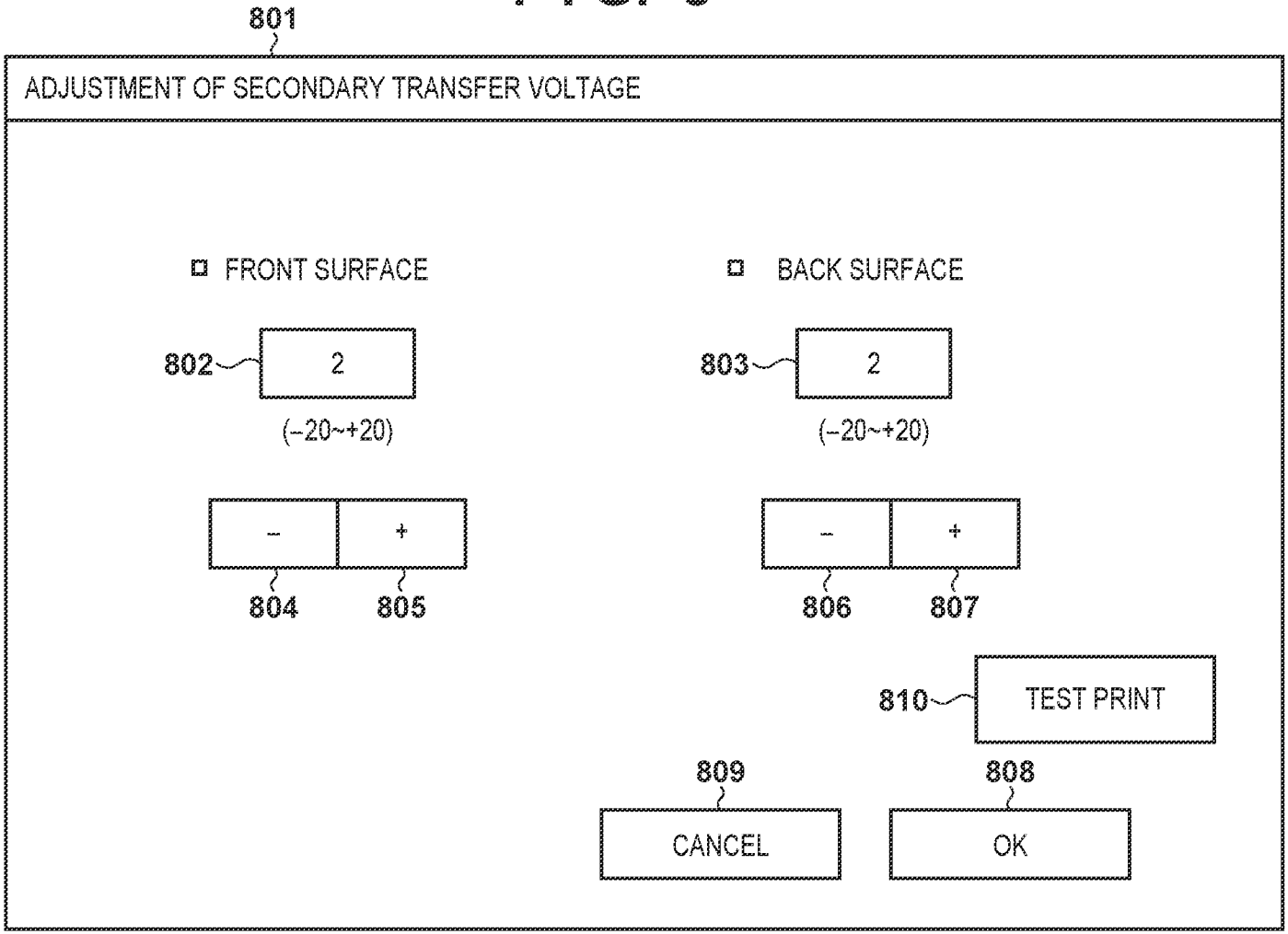
FIG. 8 depicts a view showing an example of a secondary transfer voltage adjustment screen displayed by the print control apparatus according to the first embodiment.

FIG. 8 depicts a view showing an example of the secondary transfer voltage adjustment screen displayed by the print control apparatus 102 according to the first embodiment.

This secondary transfer voltage adjustment screen 801 draws image data in its video memory in accordance with an instruction from the CPU 301 and is output/displayed to/on the display unit 113 by using the image data drawn in the video memory as a video signal. This adjustment screen 801 is a screen capable of changing a secondary transfer voltage adjustment value. A value that adjusts a voltage value when toner is transferred to the front surface of a sheet is set in a text box 802. A value that adjusts a voltage value when toner is transferred to the back surface of a sheet is set in a text box 803. It is possible to select these text boxes and input numerical values directly here. It is also possible, however, to change the numerical values by pressing corresponding— buttons 804 and 806, and +buttons 805 and 807. In order to reflect the numerical values set on this screen, the user presses an OK button 808. If the OK button 808 is pressed, the sheet management application saves an adjustment value set on this screen, and simultaneously, transmits the adjustment value to the image forming apparatus 101 in order to change the adjustment value of the image forming apparatus 101. Upon receiving this adjustment value, the image forming apparatus 101 changes the setting value of the secondary transfer voltage in accordance with the received adjustment value. If the OK button 808 is pressed, this screen 801 ends. If a cancel button 809 is pressed, the screen 801 ends without reflecting the adjustment value set on this screen. A test print button 810 is a button that executes test print in order to confirm a specific print result to be obtained by the adjustment value set here. If the test print button 810 is pressed, a sheet feed source selection screen for test print shown in FIG. 9 is displayed on the display unit 113.

Figure 9:
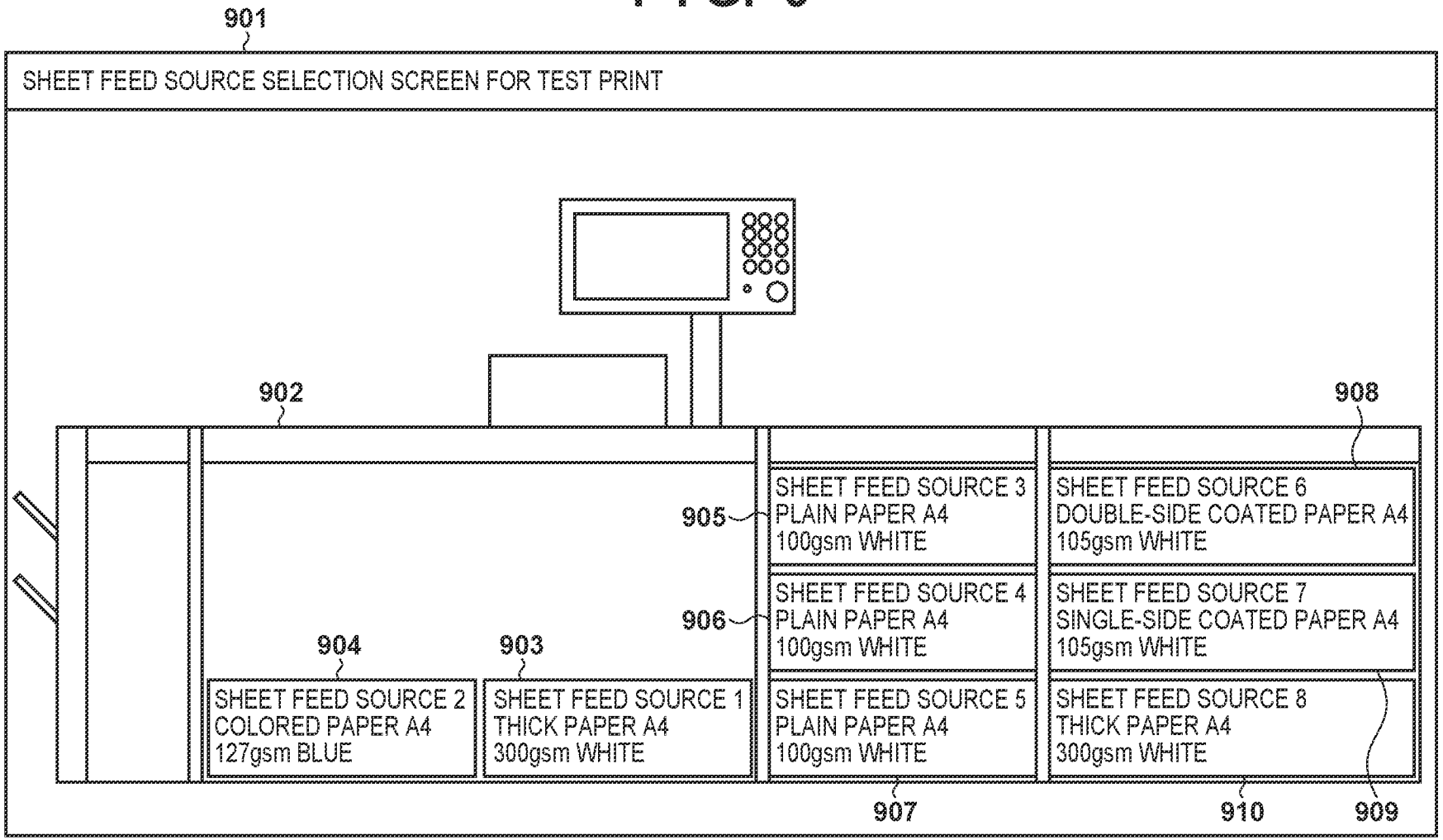
FIG. 9 depicts a view showing an example of a sheet feed source selection screen for test print displayed by the print control apparatus according to the first embodiment.

FIG. 9 depicts a view showing an example of a sheet feed source selection screen 901 for test print displayed by the print control apparatus 102 according to the first embodiment. This screen 901 draws image data in its video memory in accordance with an instruction from the CPU 301 and is output/displayed to/on the display unit 113 by using the image data drawn in the video memory as a video signal.

On this screen 901, the image of the image forming apparatus 101 and a screen on which sheet feed source buttons are arranged are displayed. Reference numeral 902 denotes the current connection states of the hardware options of the image forming apparatus 101 connected to the print control apparatus 102. The user can select a sheet feed source on which a secondary transfer voltage adjustment test is to be executed among sheet feed source buttons 903 to 910 and perform test print on a sheet fed from the selected sheet feed source. For example, if the button 903 of sheet feed source 1 is selected now, the sheet management application transmits, to the image forming apparatus 101, the secondary transfer voltage adjustment values set in the text boxes 802 and 803 of FIG. 8, and test print execution information. The image forming apparatus 101 executes test print based on these data.

A process of the print control apparatus 102 according to the first embodiment of the present invention will now be described with reference to a flowchart of FIG. 10.

Figure 10:
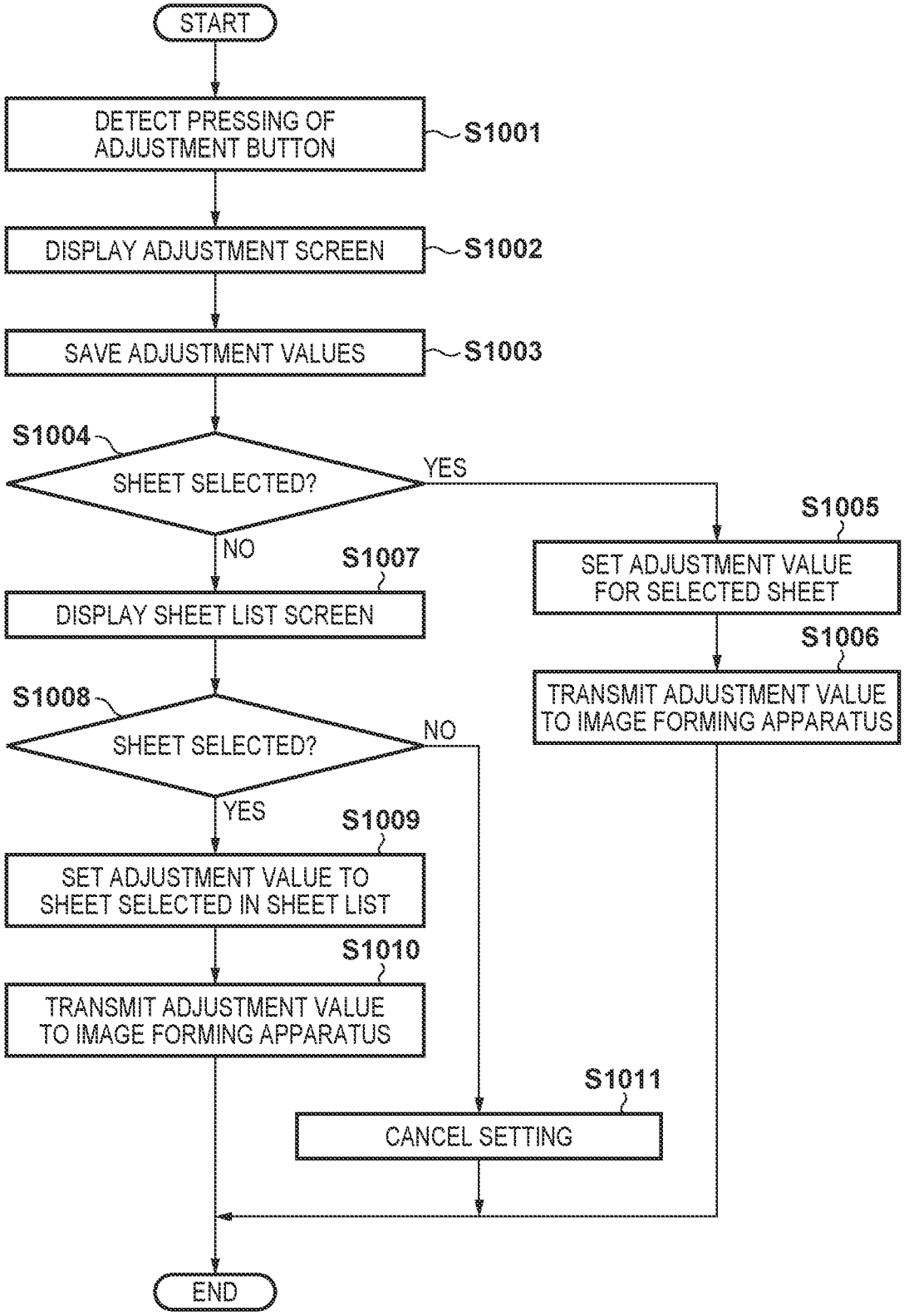
FIG. 10 is a flowchart for describing a process of the print control apparatus according to the first embodiment.

FIG. 10 is the flowchart for describing the process of the print control apparatus 102 according to the first embodiment. Note that the process shown in this flowchart is achieved by causing the CPU 301 to deploy programs stored in the external storage device 309 to the RAM 302 and execute them. Note that a description will be given in the first embodiment by taking adjustment of the secondary transfer voltage as an example. However, the same also applies to processes in the other adjustment functions.

First, in step S1001, if the CPU 301 detects that the secondary transfer voltage adjustment button 419 is pressed on the screen of FIG. 4B, the process advances to step S1002. In step S1002, the CPU 301 displays, for example, the secondary transfer voltage adjustment screen 801 as shown in FIG. 8. Then, if the CPU 301 detects that the OK button 808 is pressed on the secondary transfer voltage adjustment screen 801, the CPU 301 obtains the secondary transfer voltage adjustment values set in the text boxes 802 and 803, and the process advances to step S1003. In step S1003, the CPU 301 obtains the set setting values, saves them in the RAM 302 temporarily, and the process advances to step S1004.

In step S1004, the CPU 301 determines whether or not a sheet to be adjusted is being selected and the process advances to step S1005 if it determines that the sheet is being selected. In step S1005, the CPU 301 saves the setting values saved temporarily in step S1003 in a secondary transfer voltage adjustment value of the selected sheet and the process advances to step S1006. In step S1006, the CPU 301 transmits a setting value for changing the secondary transfer voltage adjustment value of the selected sheet to the image forming apparatus 101 and terminates this process. Consequently, upon receiving this data, the image forming apparatus 101 updates the sheet list information that has already been created.

Figure 11:
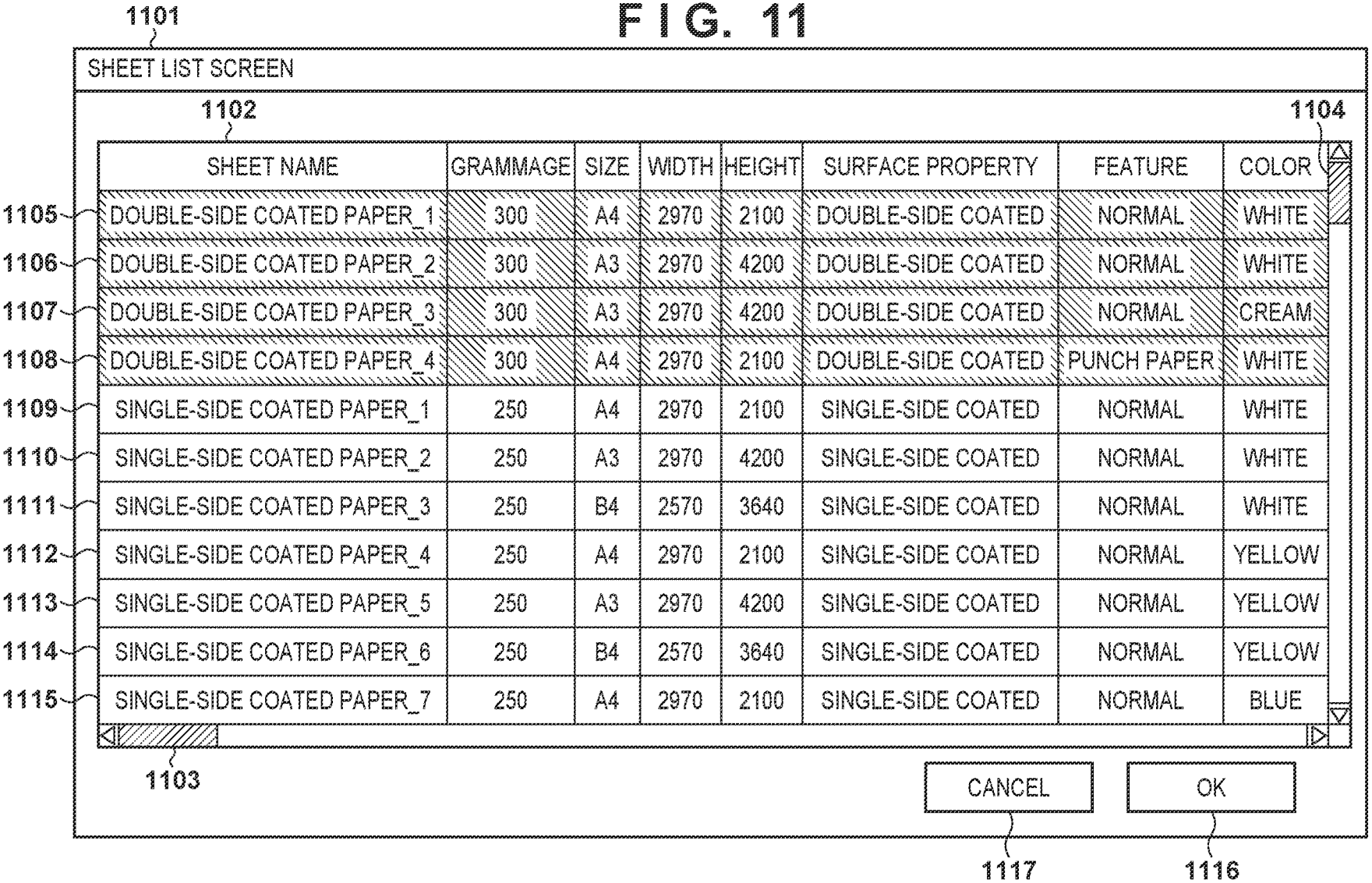
FIG. 11 depicts a view showing an example of a sheet list screen displayed by the print control apparatus according to the first embodiment.

On the other hand, in step S1004, if the CPU 301 determines that the sheet to be adjusted is not being selected, the process advances to step S1007. This case is a case in which adjustment is performed before sheet selection, and adjusted contents are to be reflected on a sheet selected later. In step S1007, the CPU 301 displays sheet list information of the sheet management application. FIG. 11 depicts a view showing an example of a sheet list screen.

FIG. 11 depicts a view showing an example of a sheet list screen displayed by the print control apparatus 102 according to the first embodiment. This sheet list screen draws image data in its video memory in accordance with an instruction from the CPU 301 and is output/displayed to/on the display unit 113 by using the image data drawn in the video memory as a video signal.

A top screen 1101 of the sheet list screen is shown here. A table 1102 displays a sheet list in which the type of sheet is displayed in each row, and sheet attribute information is displayed in each column. If the user wants to display sheet attribute information other than the sheet attribute information displayed here, he/she can display it by operating a slider bar 1103. In addition, if the user wants to display a sheet other than the displayed sheets, he/she can display it by operating a slider bar 1104. Sheets 1105 to 1115 indicate the types of sheets that are currently displayed in the table 1102 of the sheet list. Out of these, the sheets 1105 to 1108 are selected and highlighted so as to be seen that they are selected, as compared with a case in which the sheets are not selected. The sheets 1109 to 1115 are not selected. If an OK button 1116 is pressed in this state, the secondary transfer voltage adjustment values saved in step S1003 are reflected on the selected sheets. If a cancel button 1117 is pressed, the setting of this screen is canceled.

In the first embodiment, because of adjustment of the secondary transfer voltage, this adjustment value may be set to sheets having common grammage and surface property. Therefore, FIG. 11 represents a state in which double-side coated paper_1 to double-side coated paper_4 of the sheets 1105 to 1108 having common grammage and surface property are selected a number of times. Double-side coated paper_2 of the sheet 1106 is different from the sheet 1105 in that its size is A3. Double-side coated paper_3 of the sheet 1107 is different from the sheet 1105 in that its size is A3, and its color is cream. Double-side coated paper_4 of the sheet 1108 is different in that its feature is punch paper. If the OK button 1116 or the cancel button 1117 is pressed in this selection, the process advances to step S1008. If the sheet is selected, and the OK button 1116 is pressed, the process advances from step S1008 to step S1009. When the sheet is not selected, the user may not be able to press the OK button 1116. In step S1009, the CPU 301 reflects the setting values saved in step S1003 in the secondary transfer voltage adjustment values of all the sheets selected on the sheet list screen with respect to a sheet list managed by itself and the process advances to step S1010. In step S1010, the CPU 301 transmits data for changing the secondary transfer voltage adjustment values of the selected sheets to the image forming apparatus 101. Consequently, upon receiving this data, the image forming apparatus 101 updates, in step S605, the sheet list information that has already been created.

If the cancel button 1117 is pressed, the process advances from step S1008 to step S1011 in which the CPU 301 cancels the setting of the screen and terminates this process.

As described above, according to the first embodiment, desired sheet information can be set to each sheet feed source of the image forming apparatus. Then, in correspondence with the set sheet, it is possible to instruct the image forming apparatus 101 by setting an adjustment value such as a secondary transfer voltage or the like.

Furthermore, upon forming an image on a sheet, various adjustment values influenced by the characteristics of the image forming apparatus are set, and then a plurality of sheets to which the setting values are to be set can be selected from a sheet list, and the adjustment values can be set in common to the selected plurality of sheets.

Second Embodiment

A process of a print control apparatus 102 according to the second embodiment of the present invention will now be described. Note that the arrangements of an image forming apparatus 101, the print control apparatus 102, and a printing system including these according to the second embodiment are the same as in the aforementioned first embodiment, and thus a description thereof will be omitted.

Figure 12:
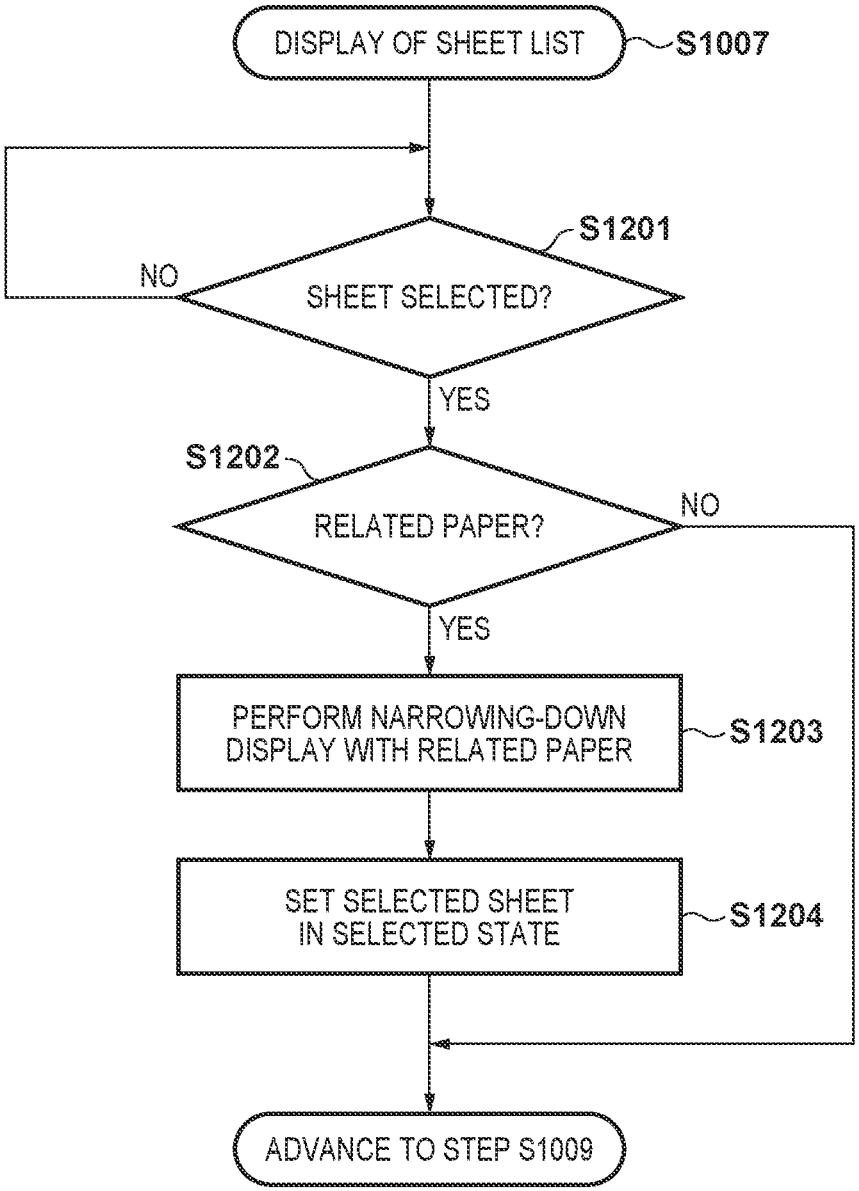
FIG. 12 is a flowchart for describing an example of display processing in steps S1007 to S1009 of FIG. 10 by a print control apparatus according to a second embodiment.

FIG. 12 is a flowchart for describing display processing in steps S1007 to S1009 of FIG. 10 by the print control apparatus 102 according to the second embodiment. Note that the processing shown in this flowchart is achieved by causing a CPU 301 to deploy programs stored in an external storage device 309 to a RAM 302 and execute them. Note that in the second embodiment, a description will be given by taking adjustment of a secondary transfer voltage as an example. However, the same also applies to processes in other adjustment functions. Note that in this FIG. 12, a description of processing from step S1007 to step S1009 in a flowchart of FIG. 10 will be given.

Figure 13A:
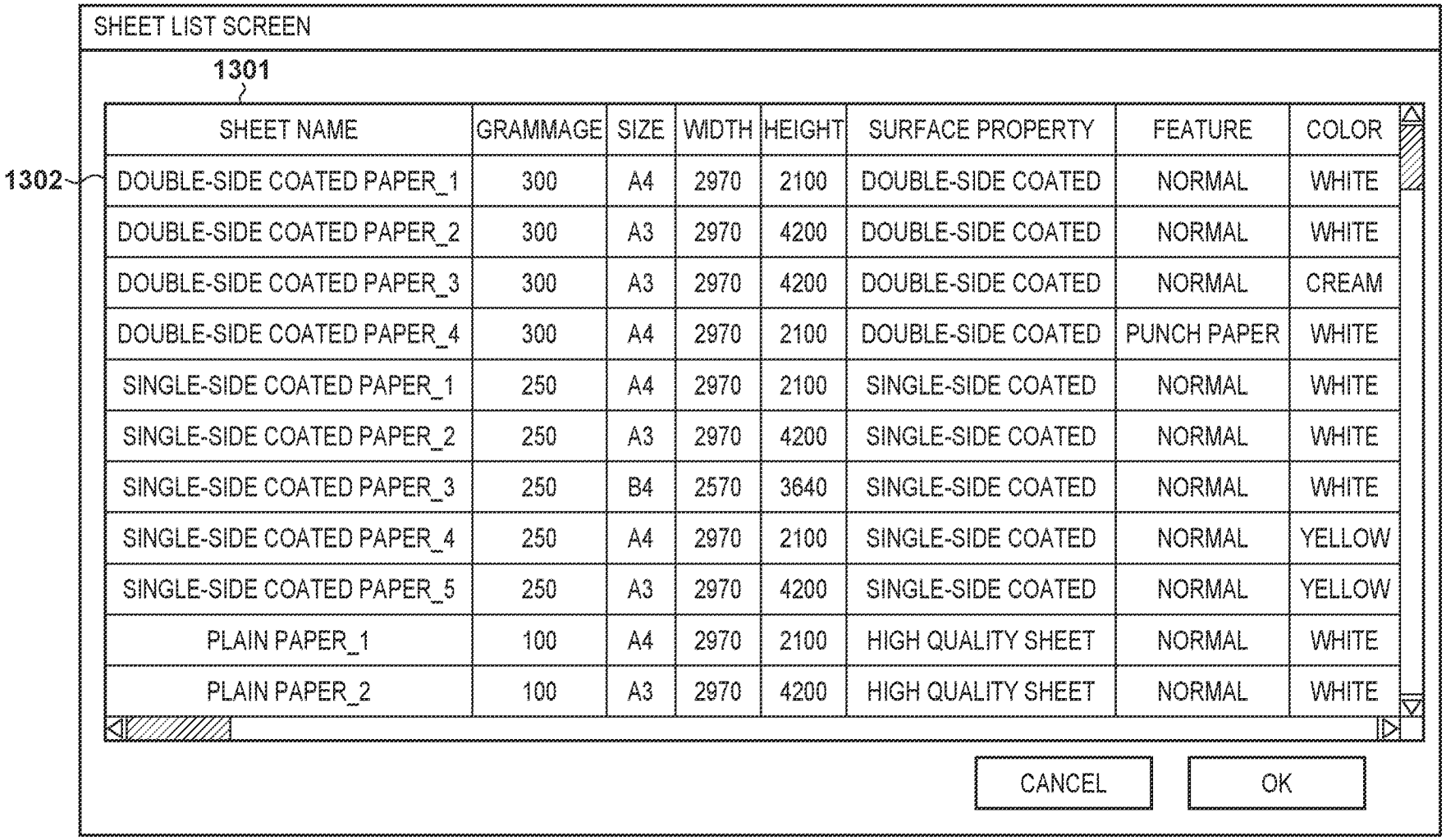
FIGS. 13A and 13B depict views each showing an example of a sheet list screen displayed by the print control apparatus according to the second embodiment.

Upon displaying a sheet list screen in step S1007, a screen shown in FIG. 13A is displayed, and the process shifts to step S1201.

FIG. 13A depicts a view showing an example of a sheet list screen displayed by the print control apparatus 102 according to the second embodiment. This is a displayed initial state in which none of sheets on a displayed sheet list screen 1301 has been selected yet.

In step S1201, the CPU 301 determines whether or not one of the sheets is selected on the screen of FIG. 13A. If, for example, a sheet 1302 is selected in FIG. 13A, the process advances to step S1202. In step S1202, the CPU 301 confirms whether a related sheet of the sheet 1302 exists from a sheet list. The related sheet of the sheet 1302 has the same sheet database of a creation source used when sheet information is created. When sheet information is newly created in the image forming apparatus 101, it may be created based on template sheet information in which basic sheet information as the sheet database is set. When an operator using the image forming apparatus 101 newly registers sheet information, he/she uses sheet information having an attribute close to that of a sheet to be registered. That is, it becomes possible to register sheet information easily and newly by copying a selected template and changing only a part different from sheet information to be registered. If sheet information is newly created with such a sequence, template information of a source is added to the new sheet information. A related sheet is sheet information created by using the same template. The sheet information created by using the same template is sheets very close to each other in sheet attribute. That is, the same adjustment value is likely to be set to such a related sheet.

Figure 13B:
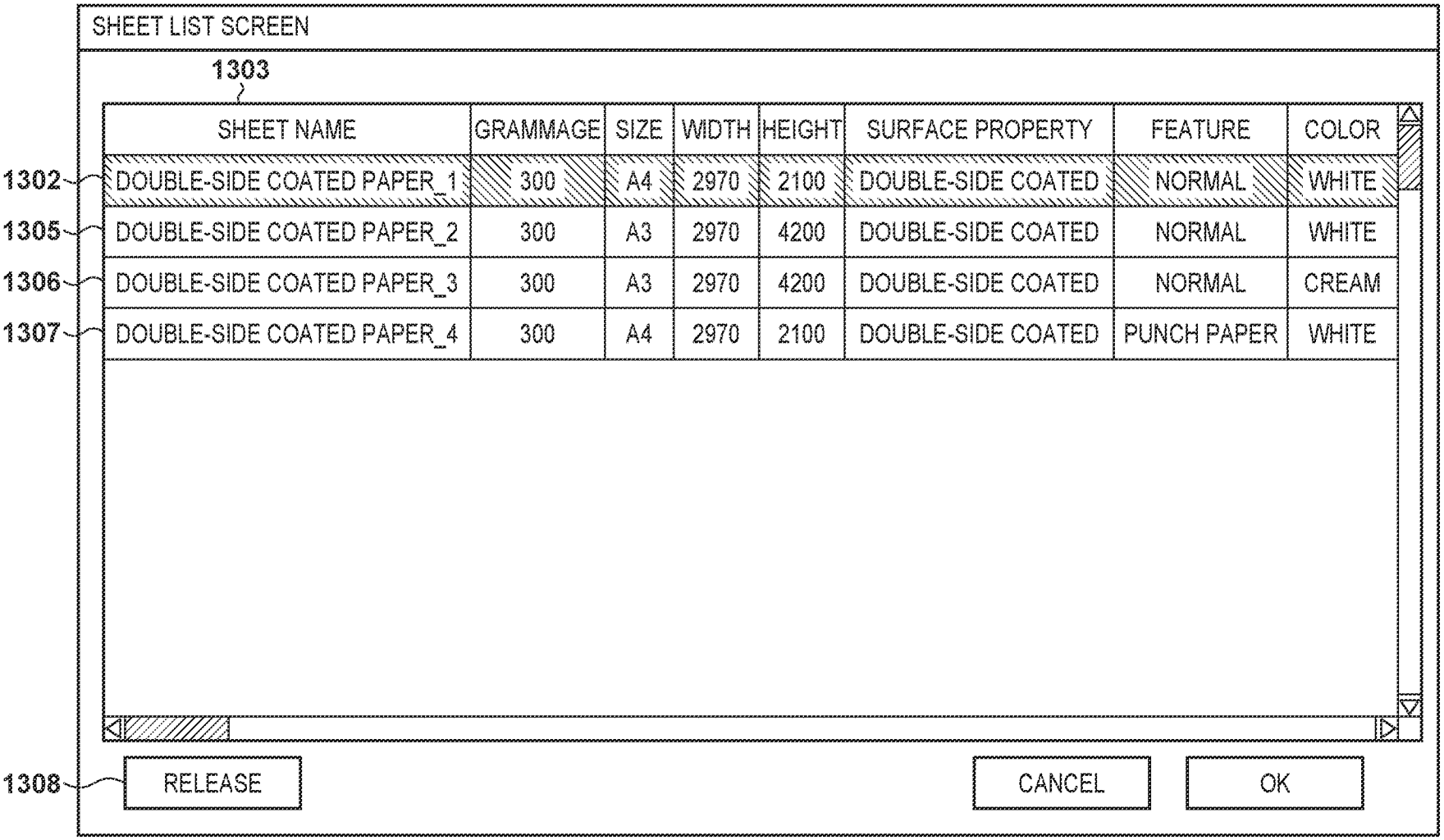

In step S1202, if the CPU 301 determines that there exists the related sheet, the process advances to step S1203. In step S1203, the CPU 301 performs narrowing-down display with the related sheet of the sheet 1302. FIG. 13B shows an example of a sheet list screen displayed by the print control apparatus 102 according to the second embodiment and shows an example in which narrowing-down display is executed with the related sheet of the sheet 1302.

A sheet list screen 1303 shows a result of performing narrowing-down display. The sheet 1302 is the same sheet as the sheet 1302 in FIG. 13A and highlighted by being selected. Sheets 1305 to 1307 are related sheets of the sheet 1302. Therefore, sheets of single-side coated paper displayed on the sheet list screen 1301 of FIG. 13A are not related sheets of the sheet 1302, and thus not displayed on the screen of FIG. 13B. If a release button 1308 is pressed here, narrowing-down display ends. Once a release operation is performed, the display of this release button 1308 is changed to "narrowing-down" next, and a narrowing-down state can be displayed as shown in FIG. 13B by pressing the button 1308 again. Then, in step S1204, the CPU 301 highlights the selected sheet information and terminates this process.

On the other hand, if the CPU 301 determines in step S1202 that there is no related sheet, the process advances to step S1009 in which it displays all the sheets without narrowing down the sheets and terminates this process. As another example, if the CPU 301 determines in step S1202 that there is no related sheet, the process advances to step S1203 in which only the selected sheet may be displayed. Alternatively, a pop-up screen indicating the absence of the related sheets may be displayed so as to make an operator select a shift to step S1009 or step S1203. The process from step S1009 is the same as in the first embodiment, and thus a description thereof will be omitted.

As described above, according to the second embodiment, it is possible to set, for a plurality of types of sheets having sheet information close to selected sheet information (sheet attribute), adjustment values suitable for those sheets easily.

Third Embodiment

A process of a print control apparatus 102 according to the third embodiment of the present invention will now be described with reference to a flowchart of FIG. 14. Note that the arrangements of an image forming apparatus 101, the print control apparatus 102, and a printing system including these according to the third embodiment are the same as in the aforementioned first embodiment, and thus a description thereof will be omitted.

Figure 14:
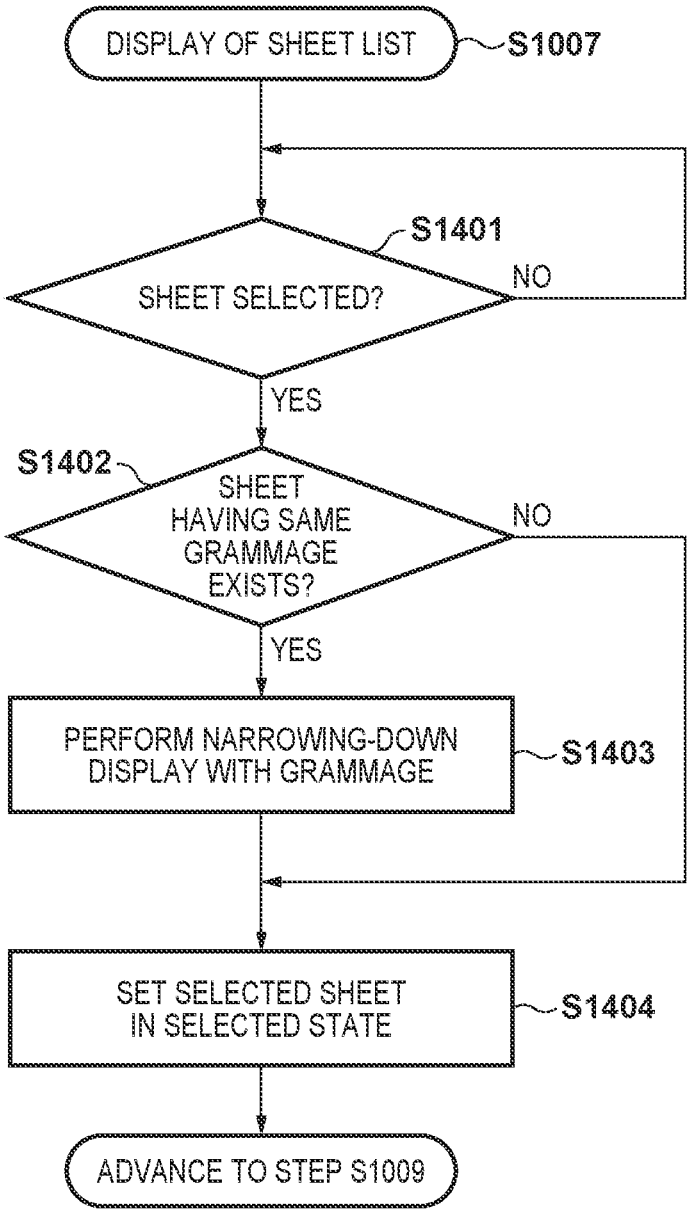
FIG. 14 is a flowchart for describing processing in steps S1007 to S1009 of FIG. 10 by a print control apparatus according to a third embodiment.

FIG. 14 is the flowchart for describing processing in steps S1007 to S1009 of FIG. 10 by the print control apparatus 102 according to the third embodiment. Note that the processing shown in this flowchart is achieved by causing a CPU 301 to deploy programs stored in an external storage device 309 to a RAM 302 and execute them. Note that in the third embodiment, a description will be given by taking adjustment of a secondary transfer voltage as an example. However, the same also applies to processes in other adjustment functions.

Figure 15A:
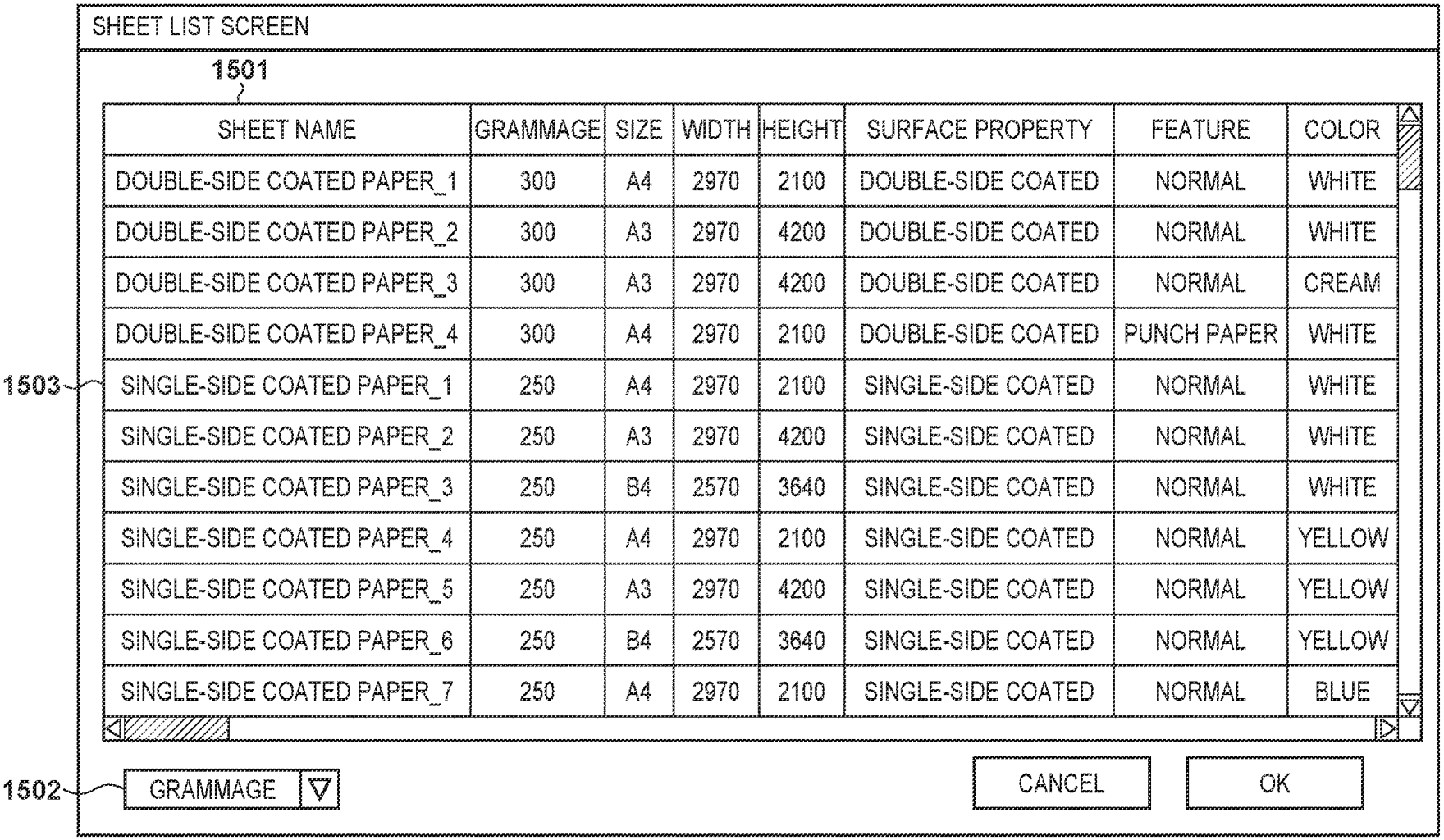
FIGS. 15A and 15B depict views each showing an example of a sheet list screen displayed by the print control apparatus according to the third embodiment.

Upon displaying a sheet list screen in step S1007, a screen shown in FIG. 15A is displayed, and the process shifts to step S1401.

FIG. 15A shows a view illustrating a displayed initial state in which none of sheets on a sheet list screen 1501 has not been selected yet. A narrowing-down element selection list box 1502 can select a sheet attribute shown in each column of the sheet list screen 1501. With an attribute selected from this list, it becomes also possible to perform narrowing-down display again by a selected sheet.

In step S1401, the CPU 301 confirms whether any sheet is selected in FIG. 15A. If a sheet 1503 is selected in FIG. 15A, the process advances to step S1402. In step S1402, the CPU 301 performs narrowing-down based on grammage set in the box 1502. In the third embodiment, a sheet attribute with the largest influence is held in each adjustment function, and narrowing-down processing is executed automatically by this attribute. In the third embodiment, a description is given based on a secondary transfer voltage adjustment function, and grammage has the largest influence at the time of adjustment of a secondary transfer voltage. Therefore, in the third embodiment, a description will be given assuming that narrowing-down is performed with grammage having the same numerical value. However, narrowing-down display may be performed by various designation methods using, for example, a size and a range.

In step S1402, the process advances to step S1403 if there exists a sheet having the same grammage as the sheet 1503. In step S1403, the CPU 301 performs narrowing-down display with the sheet having the same grammage as the sheet 1503.

Figure 15B:
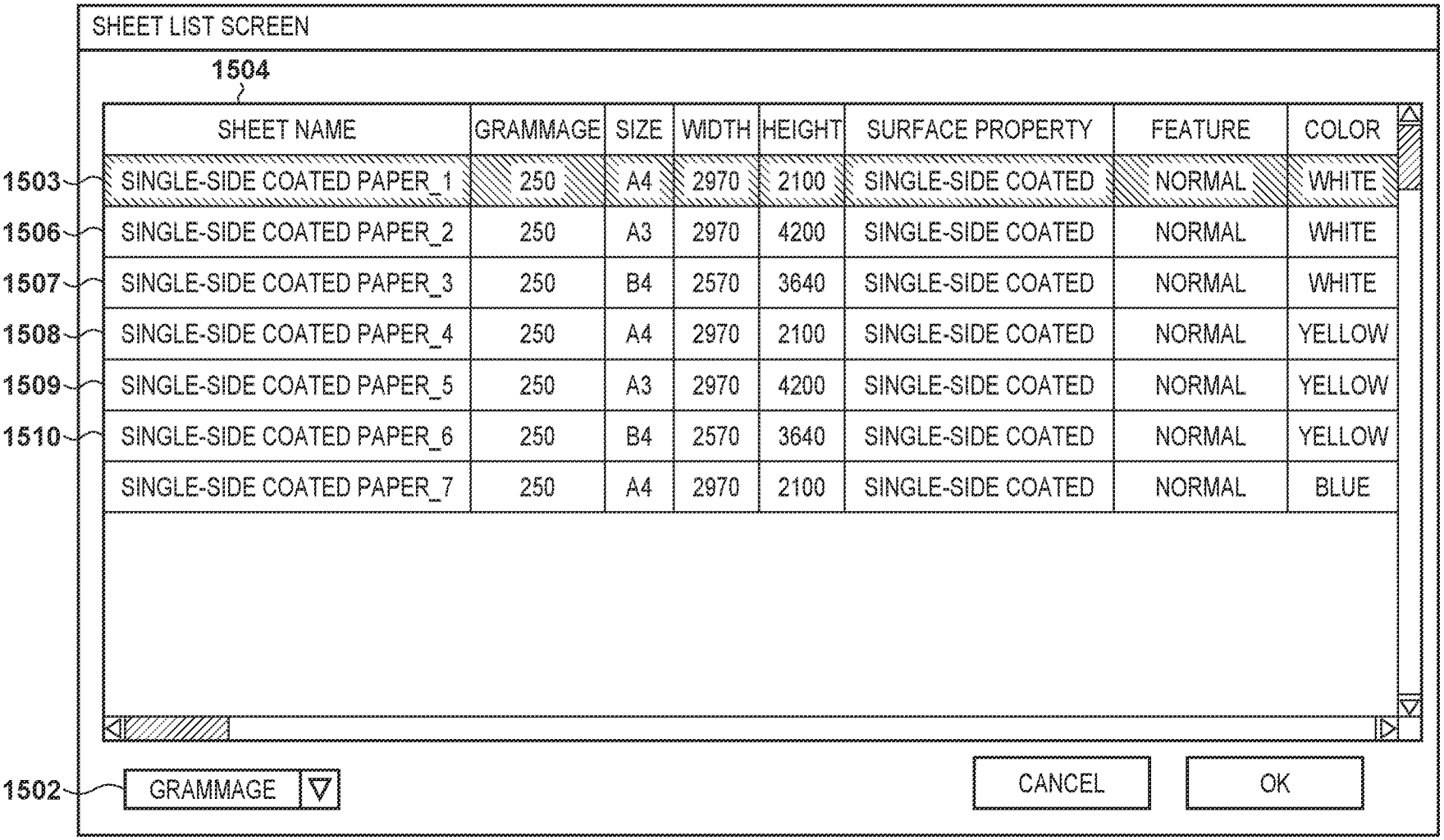

FIG. 15B depicts a view showing an example in which sheets are listed by performing narrowing-down display with the sheet having the same grammage as the sheet 1503.

On a sheet list screen 1504 that has undergone narrowing-down display, the sheet 1503 is highlighted by being selected. Sheets 1506 to 1510 have the same grammage as the sheet 1503. Sheets of double-side coated paper displayed in the sheet list screen 1501 of FIG. 15A are not sheets having the same grammage as the sheet 1503, and thus not displayed. This narrowing-down display ends by selecting none of elements (selecting a blank line) in the element selection list box 1502. Information on a sheet attribute that is narrowed down currently is displayed in the element selection list box 1502. In the third embodiment, sheets narrowed down by grammage are displayed. It becomes possible to display the narrowing-down state again by selecting an element from the element selection list box 1502.

On the other hand, if it is determined in step S1402 that there is no sheet having the same grammage, the process advances to step S1404 in which the CPU 301 displays all the sheets without narrowing down them. As another mode, when the process advances to step S1403, only a selected sheet may be displayed, or a pop-up screen indicating the absence of a sheet having the same grammage may be displayed so as to make the operator select a shift to step S1403 or step S1404. The process from step S1009 is the same as in the first embodiment, and thus a description thereof will be omitted.

As described above, according to the third embodiment, it is possible to set, for a plurality of types of sheets having sheet information close to selected sheet information (sheet attribute (grammage here)), adjustment values suitable for those sheets easily.

Fourth Embodiment

A process of a print control apparatus 102 according to the fourth embodiment of the present invention will now be described with reference to a flowchart of FIG. 16. Note that the arrangements of an image forming apparatus 101, the print control apparatus 102, and a printing system including these according to the fourth embodiment are the same as in the aforementioned first embodiment, and thus a description thereof will be omitted.

Figure 16:
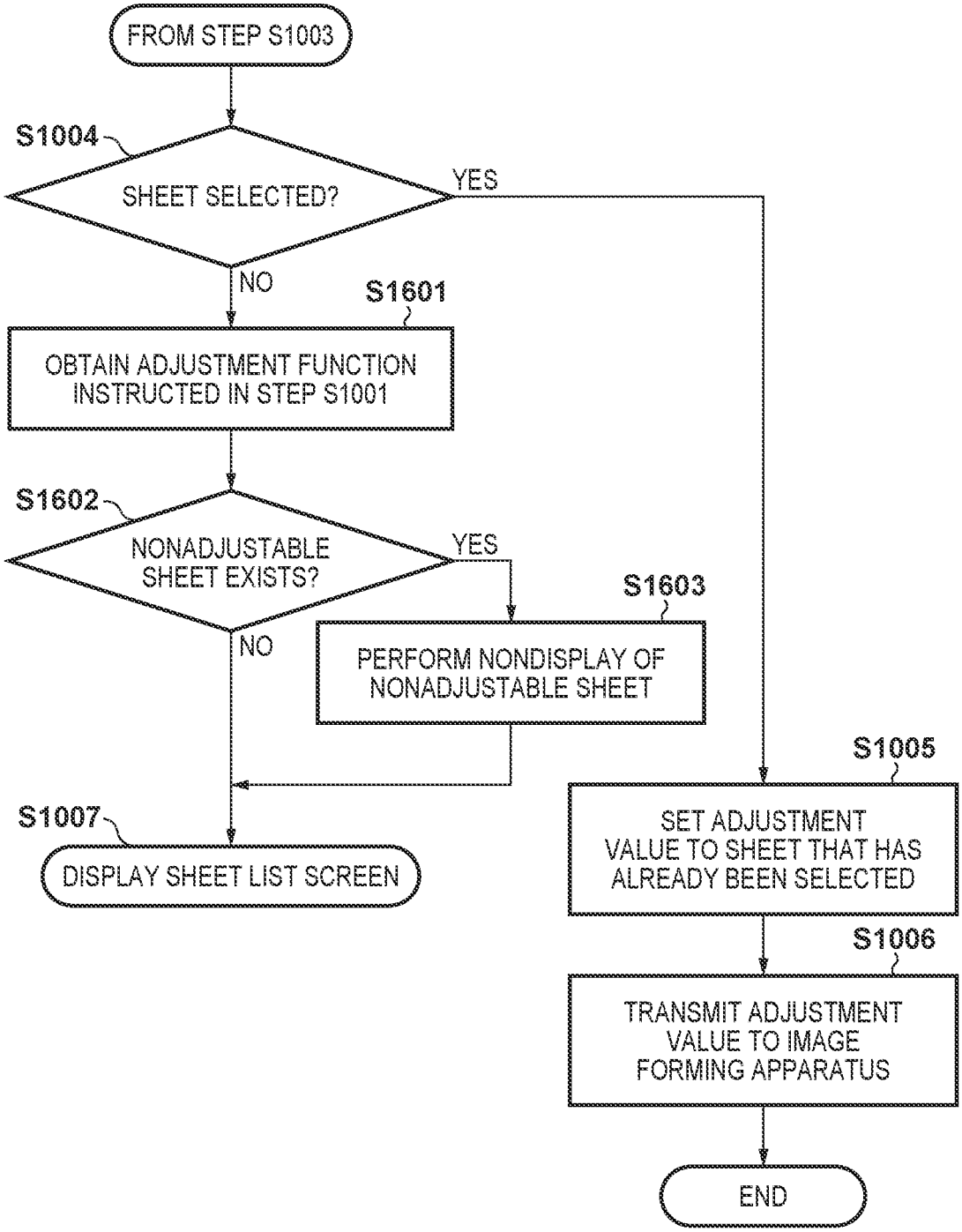
FIG. 16 is a flowchart for describing processing from step S1003 of FIG. 10 in a print control apparatus according to a fourth embodiment.

FIG. 16 is the flowchart for describing processing from step S1003 of FIG. 10 in the print control apparatus 102 according to the fourth embodiment. Note that the processing shown in this flowchart is achieved by causing a CPU 301 to deploy programs stored in an external storage device 309 to a RAM 302 and execute them. The same reference numerals as in FIG. 10 denote the same parts in FIG. 16, and a description thereof will be omitted. Note that in the first embodiment described above, the description has been given based on adjustment of the secondary transfer voltage. In the fourth embodiment, however, a description will be given based on adjustment of glossiness/black grade. Glossiness/black grade can be adjusted by pressing a button 420 in FIG. 4. In FIG. 7, although adjustment of glossiness/black grade is not displayed, it is displayed in a display area 715 by operating a slider bar 716. The same adjustment can also be performed by pressing this undisplayed button.

First, in step S1004, the CPU 301 determines whether or not a sheet to be adjusted has already been selected. If the sheet has not been selected, the process advances to step S1601. In step S1601, the CPU 301 obtains a specific adjustment function to which the button pressed in step S1001 corresponds and the process advances to step S1602. In step S1602, the CPU 301 determines whether or not there are any nonadjustable sheets in the adjustment function obtained in step S1601. In the fourth embodiment, a description will be given assuming that a sheet management application holds, in advance, a setting of whether adjustment can be performed. However, this information may be obtained from the image forming apparatus 101. A case in which there is the nonadjustable sheet will be described based on adjustment of glossiness/black grade. The description will be given with reference to FIG. 17 by pressing the button 420 of FIG. 4.

Figure 17:
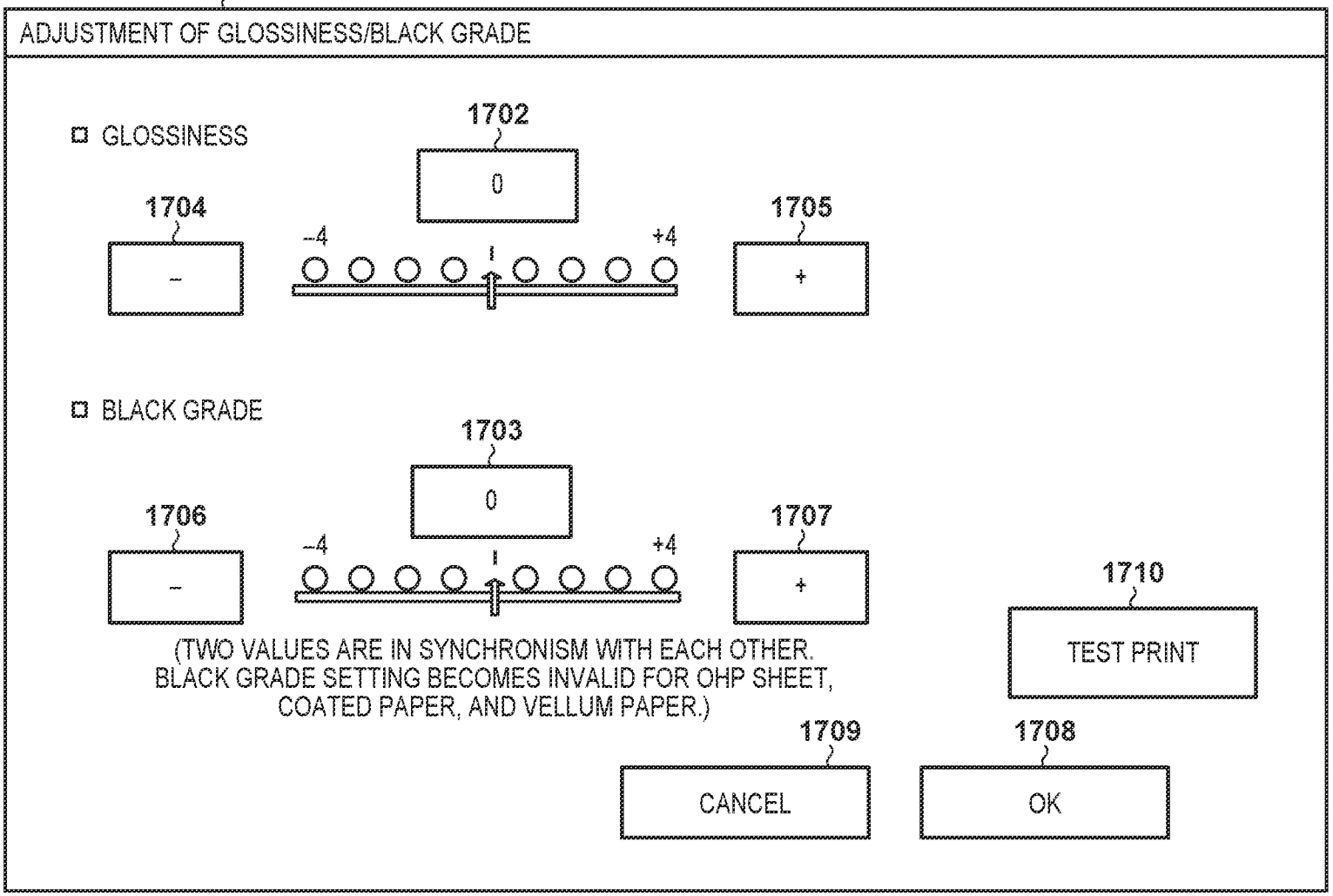
FIG. 17 depicts a view showing an example of a glossiness/black grade adjustment screen displayed by the print control apparatus according to the fourth embodiment.

FIG. 17 depicts a view showing an example of a glossiness/black grade adjustment screen 1701 displayed by the print control apparatus 102 according to the fourth embodiment. This screen draws image data in its video memory in accordance with an instruction from the CPU 301 and is output/displayed to/on a display unit 113 by using the image data drawn in the video memory as a video signal.

This screen 1701 is a screen capable of changing glossiness/black grade adjustment values. This screen 1701 includes a text box 1702 that adjusts glossiness and a text box 1703 that adjusts a black grade. Here, it is possible to select these text boxes and input numerical values there directly. It is also possible, however, to change those numerical values by pressing corresponding −buttons 1704 and 1706, and +buttons 1705 and 1707. In order to reflect set numerical values, an OK button 1708 is pressed. If the OK button 1708 is pressed, a sheet management application saves these setting values, and simultaneously, the setting values are transmitted in order to change the setting value of the image forming apparatus 101. Upon receiving these setting values, the image forming apparatus 101 changes glossiness/black grade setting values to the received values. If the OK button 1708 is pressed, display of the screen 1701 ends. If a cancel button 1709 is pressed, this screen ends without reflecting the values set in the text boxes 1702 and 1703 in a secondary transfer voltage adjustment value. A test print button 1710 is a button for causing the image forming apparatus 101 to perform test print in order to confirm a specific print result to be obtained by an adjusted setting value. If the test print button 1710 is pressed, a test print sheet feed source selection screen of FIG. 9 is displayed. FIG. 9 has already been described, and thus a description thereof will be omitted.

Glossiness and the black grade are adjusted in synchronism with their adjustment values. If one is changed, the other is automatically set to a corresponding value. Note that when the black grade is adjusted, this adjustment value becomes invalid for an OHP sheet, coated paper, and vellum paper. Therefore, the OHP sheet, coated paper, and vellum paper become nonadjustable sheets when this adjustment is performed.

Figure 18:
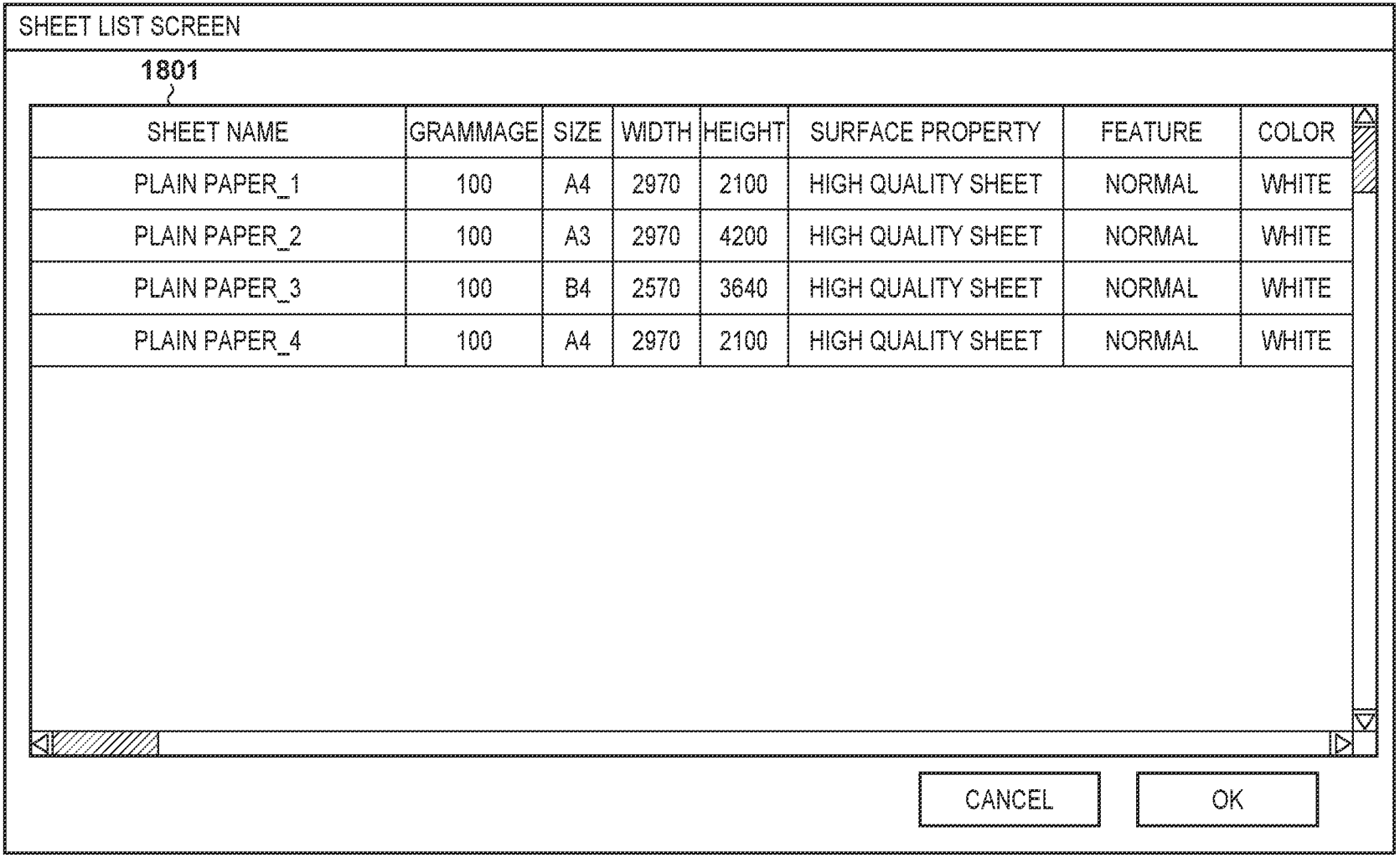
FIG. 18 depicts a view showing an example of a screen when glossiness/black grade adjustment is performed on a sheet list of FIG. 13A, and narrowing-down display is performed displayed by the print control apparatus according to the fourth embodiment.

A description will be given by referring back to the flowchart of FIG. 16. If there are the nonadjustable sheets in step S1602, the CPU 301 shifts to step S1603. In step S1603, the CPU 301 performs a process of not displaying these sheets in the sheet list and the process advances to step S1007. FIG. 18 shows a sheet list displayed by processing this sequence.

FIG. 18 depicts a view showing an example of a screen when narrowing-down display is performed by performing glossiness/black grade adjustment on the sheet list of FIG. 13A displayed by the print control apparatus 102 according to the fourth embodiment.

On a sheet list screen 1801, all sheets of coated paper shown in FIG. 13A are not displayed, and only plain paper is displayed. Step S1602 will be described again.

If there is not any nonadjustable sheet in step S1602, the process advances to step S1007 in which it displays the sheet list (FIG. 13A). The process from step S1007 is the same as in the first embodiment, and thus a description thereof will be omitted.

As described above, according to the fourth embodiment, if an adjustment item influenced by the characteristics of the image forming apparatus 101 when an image is formed by using a sheet is selected, display is performed by excluding a sheet with an attribute to which the adjustment item is not applicable from a sheet list. This makes it possible to prevent a user from selecting a sheet not to be adjusted mistakenly and setting a setting value for adjustment to that sheet.

Fifth Embodiment

A process of a print control apparatus 102 according to the fifth embodiment of the present invention will now be described with reference to flowcharts of FIGS. 19 and 20. Note that the arrangements of an image forming apparatus 101, the print control apparatus 102, and a printing system including these according to the fifth embodiment are the same as in the aforementioned first embodiment, and thus a description thereof will be omitted.

Figure 19:
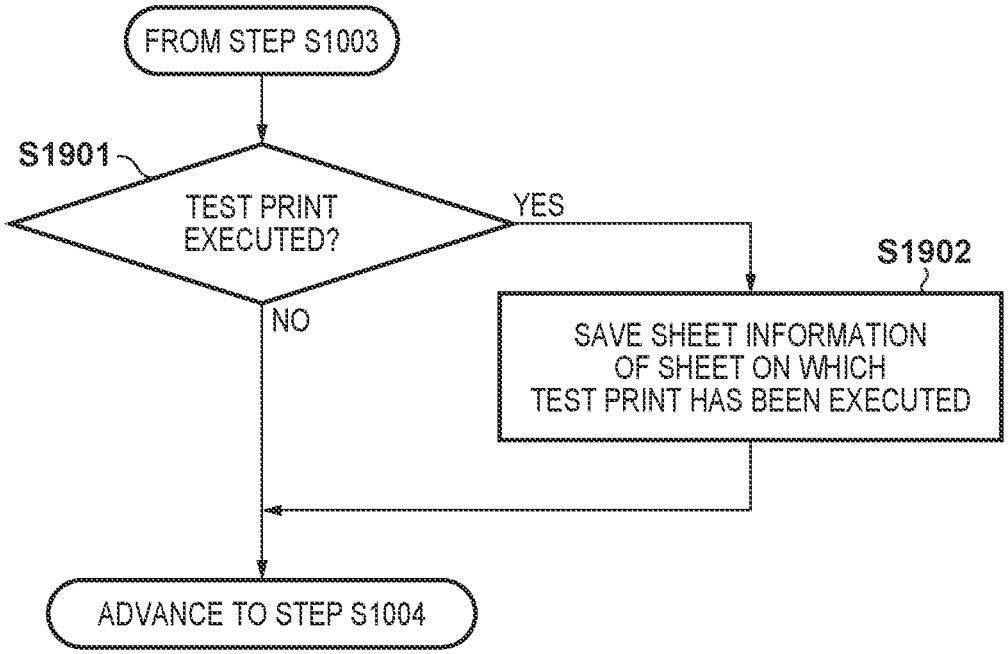
FIG. 19 is a flowchart for describing processing from step S1003 to step S1007 of FIG. 10 by a print control apparatus according to a fifth embodiment.

FIG. 19 is the flowchart for describing processing from step S1003 to step S1004 of FIG. 10 by the print control apparatus 102 according to the fifth embodiment. Note that the processing shown in this flowchart is achieved by causing a CPU 301 to deploy programs stored in an external storage device 309 to a RAM 302 and execute them. In FIG. 19, a process of saving a sheet used at the time of test print will be described.

The CPU 301 performs a process of saving a setting value on an adjustment screen in step S1003, and then the process advances to step S1901. In step S1901, the CPU 301 determines whether or not a test print is executed on the adjustment screen. Note that if the test print is not executed, the process advances to step S1007 and displays a sheet list. On the other hand, if the CPU 301 determines that the test print is executed, the process advances to step S1902. In step S1902, the CPU 301 saves sheet information of a sheet on which the test print has been performed together with information on the saved setting value and the process advances to sheet list display processing in step S1007.

A sequence for executing narrowing-down display of a sheet list by using the sheet used at the time of test print will now be described with reference to a flowchart of FIG. 20.

Figure 20:
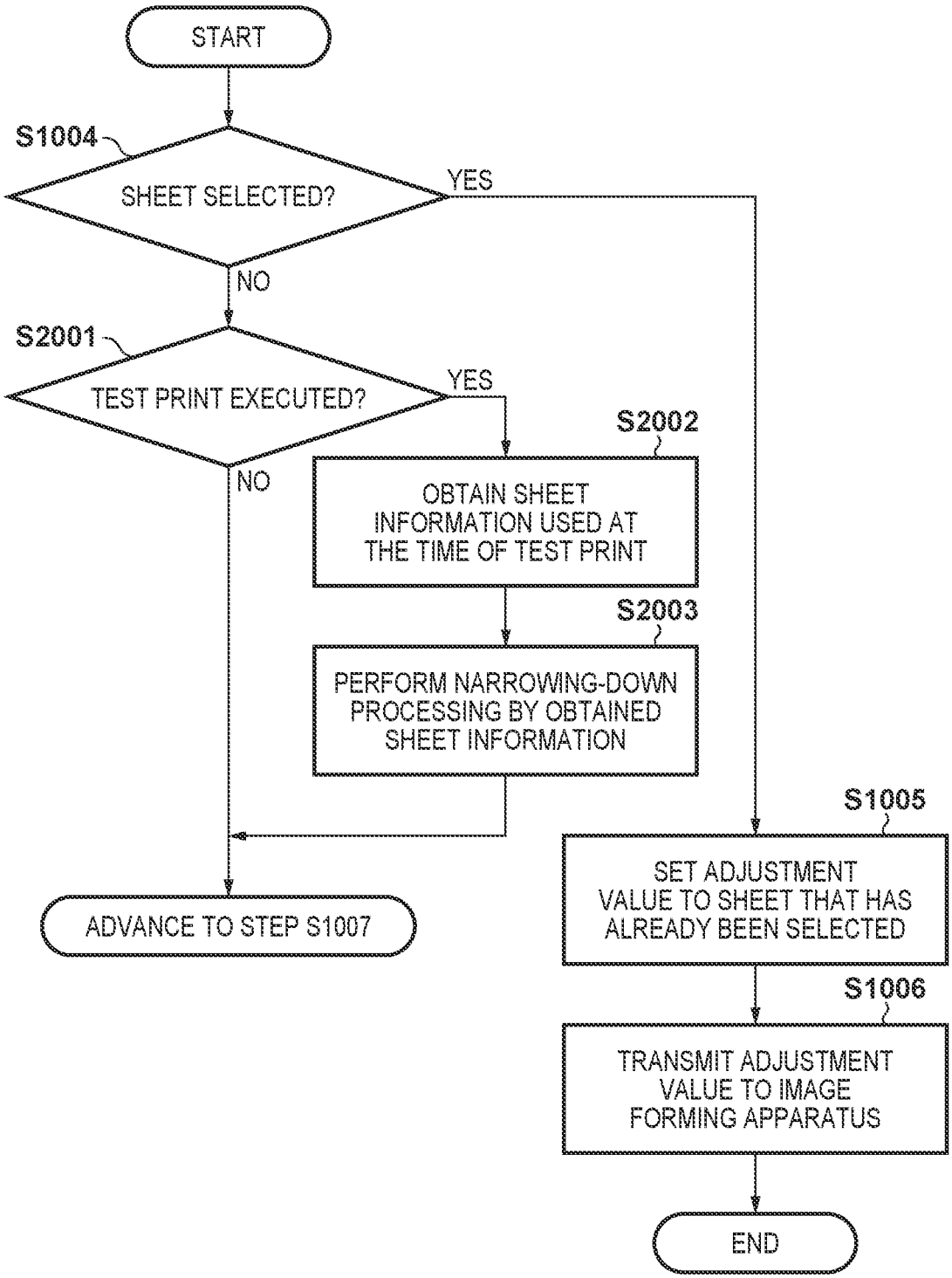
FIG. 20 is a flowchart for describing processing from step S1004 of FIG. 10 by the print control apparatus according to the fifth embodiment.

FIG. 20 is the flowchart for describing processing from step S1004 of FIG. 10 by the print control apparatus 102 according to the fifth embodiment. Note that in FIG. 20, the same reference numerals denote processing common to FIG. 10 described above, and a description thereof will be omitted.

If a sheet is not selected in step S1004, the process advances to step S2001. In step S2001, the CPU 301 determines whether or not a test print is executed at the time of adjustment. If the CPU 301 determines here that the test print is not executed, the process advances to step S1007 in which it displays the sheet list as described above.

On the other hand, if the test print is executed at the time of adjustment, the process advances to step S2002. In step S2002, the CPU 301 obtains the sheet information saved in step S1902 and used at the time of test print. Then, the process advances to step S2003 in which the CPU 301 executes sheet information narrowing-down processing based on the sheet information of the sheet used for the test print. This narrowing-down processing is executed based on the method that has already been described in each of the second to fourth embodiments, and thus a description thereof will be omitted. The CPU 301 thus executes the narrowing-down processing in step S2003, and then the process advances to step S1007 in which it displays a sheet list on which the narrowing-down processing is executed. Processing from step S1007 is the same as in the first embodiment, and thus a description thereof will be omitted.

As described above, according to the fifth embodiment, when the test print is executed at the time of adjustment, sheet information of a sheet used for the test print is stored. Then, it is possible, by narrowing down sheets with the sheet information of the sheet used for the test print and displaying a sheet list, to select a sheet to which the adjustment is applicable and set an adjustment value to the selected sheet.

Sixth Embodiment

A process of a print control apparatus 102 according to the sixth embodiment of the present invention will now be described with reference to a setting screen in FIG. 21. Note that the arrangements of an image forming apparatus 101, the print control apparatus 102, and a printing system including these according to the sixth embodiment are the same as in the aforementioned first embodiment, and thus a description thereof will be omitted.

Figure 21:
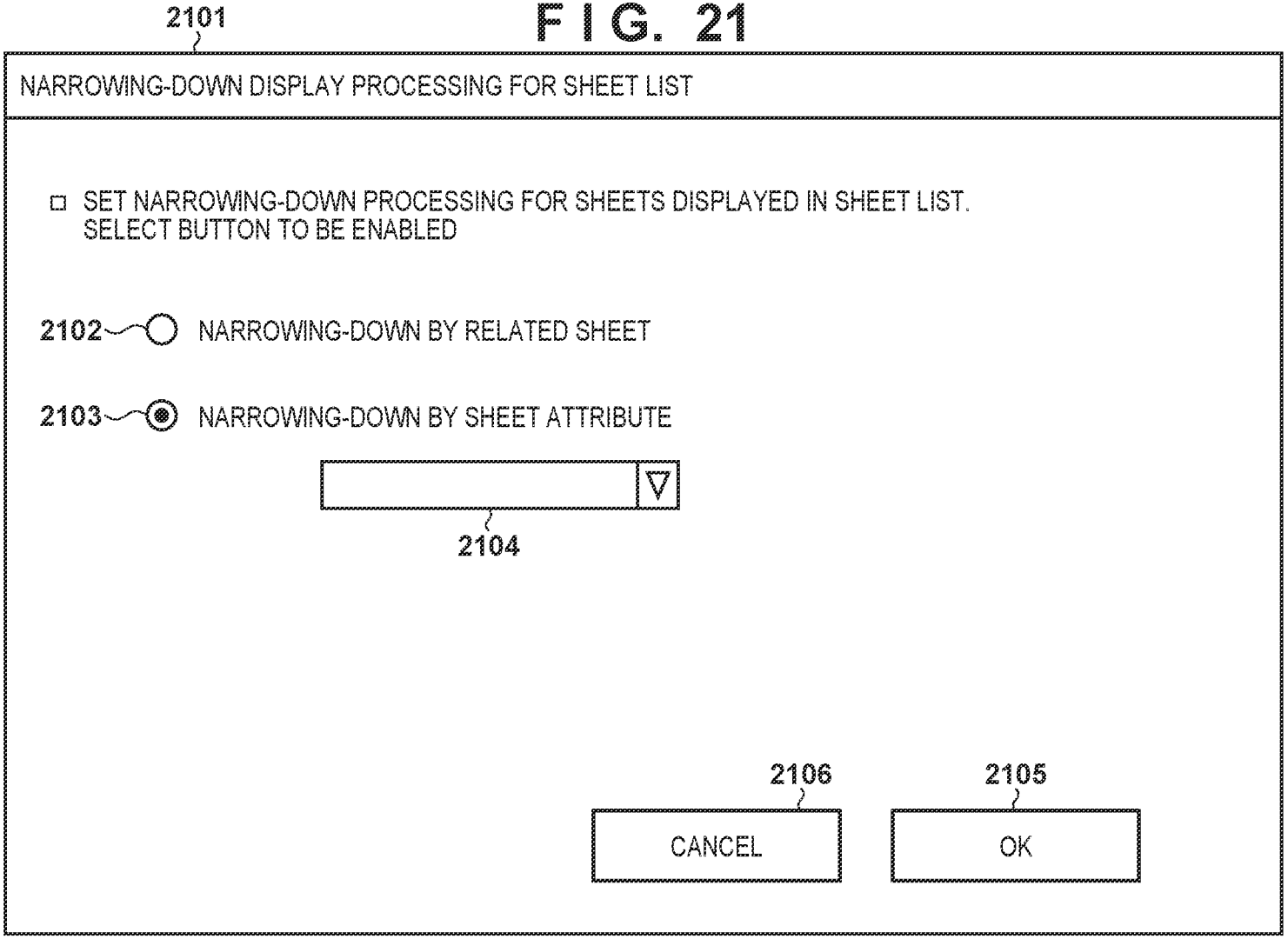
FIG. 21 depicts a view showing an example of a setting screen displayed by a print control apparatus according to a sixth embodiment.

FIG. 21 depicts a view showing an example of a setting screen displayed by the print control apparatus 102 according to the sixth embodiment. This setting screen draws image data in its video memory in accordance with an instruction from a CPU 301 and is output/displayed to/on a display unit 113 by using the image data drawn in the video memory as a video signal. FIG. 21 shows an example of a screen that sets a specific setting to be executed when a sheet management application narrows down sheets.

A top screen 2101 that performs narrowing-down display processing for a sheet list includes radio buttons 2102 and 2103, and a user selects one of these. If the user selects the radio button 2102, a narrowing-down function by the related sheet described in the second embodiment is enabled. If the user selects the radio button 2103, a narrowing-down function by the sheet attribute described in the third embodiment is enabled. A data field 2104 is used to designate a specific sheet attribute to be used for performing narrowing-down when narrowing-down by sheet attributes is executed. Note that if the user selects nothing, sheet attribute information with the largest influence is held in each adjustment function, and narrowing-down processing is executed automatically by this attribute to display the sheet list, as described in the third embodiment. An OK button 2105 can save a setting on this screen and set one of the buttons to use for narrowing-down processing when the sheet list is displayed. A cancel button 2106 cancels the setting on this screen.

As described above, according to the sixth embodiment, it is possible to select between whether narrowing-down of sheets when the sheet list is displayed is performed based on the related sheet as in the aforementioned second embodiment and whether it is performed based on the sheet attribute (for example, grammage) as in the third embodiment. Other effects are the same as in the aforementioned second to fifth embodiments.

Figure 22:
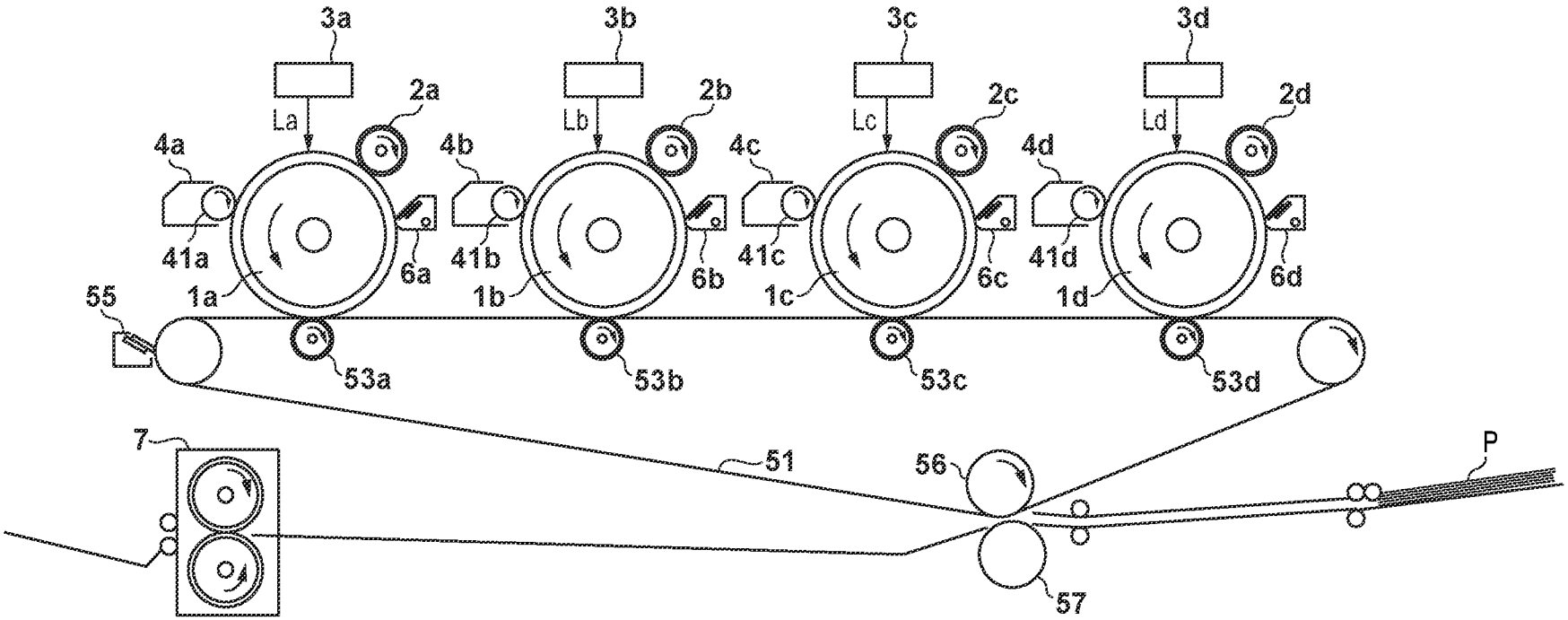
FIG. 22 depicts a view for explaining the arrangement of the main part of a printer engine according to the embodiment.

FIG. 22 depicts a view for explaining the arrangement of the main part of the printer engine 210 according to the above-described embodiment.

The printer engine 210 is an image forming apparatus that forms an image by an electrophotographic process. This printer engine 210 includes four image forming units (stations) of yellow, magenta, cyan, and black. In FIG. 22, a to d affixed to reference numerals correspond to the image forming units of yellow, magenta, cyan, and black, respectively. FIG. 22 will be described by omitting a to d. Charging rollers 2, developing devices 4, photosensitive member cleaners 6, and primary transfer rollers 53 are arranged around the drums of photosensitive members 1. Each exposure apparatus 3 generates a laser beam corresponding to image data for each color and irradiates the surface of a corresponding one of the photosensitive members 1. Each developing device 4 includes a developing sleeve 41 inside, accommodates toner as a developing material, and forms a toner image which is visualized by attracting toner to an electrostatic latent image formed in the corresponding one of the photosensitive drums 1. The toner image thus formed in the photosensitive member 1 corresponding to each color is superimposed on and transferred to an intermediate transfer belt 51 by a corresponding one of the primary transfer rollers 53, and a color image transferred onto this intermediate transfer belt 51 is transferred to a sheet P such as paper or an OHP sheet by secondary transfer rollers 56 and 57. The sheet P to which the color toner image is thus transferred is transmitted to a fixing device 7, and the transferred toner image is fixed to the sheet P. Each reference character L denotes a laser beam that exposes the corresponding one of the photosensitive members 1.

Upon receiving an image forming instruction to the sheet P, the CPU 201 that controls this printer engine 210 starts rotating the photosensitive members 1, the intermediate transfer belt 51, the charging rollers 2, the developing sleeves 41, the primary transfer rollers 53, the secondary transfer rollers 56 and 57, and the fixing roller of the fixing device 7. A high-voltage power supply (not shown) is connected to each charging roller 2, and a high voltage on which a sinusoidal voltage is superimposed is applied from this high-voltage power supply to a DC voltage. Consequently, the surface of the photosensitive member 1 in contact with the charging roller 2 is charged uniformly. Then, when the surface of this charged photosensitive member 1 reaches an irradiation position with the laser beam from the exposure apparatus 3, exposure according to an image signal is performed, and an electrostatic latent image according to the image signal is formed on the photosensitive member 1. Subsequently, a high voltage obtained by superimposing a rectangular pulse waveform voltage on a DC voltage is applied from the high-voltage power supply (not shown) to the developing sleeve 41 of the developing device 4. Consequently, negatively charged toner is attracted to an electrostatic latent image having a positive potential as compared with the developing sleeve 41 (the positive potential as compared with the developing sleeve and a negative potential relative to the GND) to change the electrostatic latent image into a visible image (toner image), and the toner image moves in the direction of the primary transfer roller 53 as the photosensitive member 1 rotates. Thus, the toner images on the four photosensitive members 1 are overlaid on and transferred to the intermediate transfer belt 51 by the corresponding primary transfer rollers 53, and further transferred to the sheet P by the secondary transfer rollers 56 and 57. Note that a DC high voltage for transferring the toner image is also applied from the high-voltage power supply (not shown) to the primary transfer rollers 53, and the secondary transfer rollers 56 and 57. Transfer residual toner remaining on each photosensitive member 1 is scraped off and collected by the corresponding photosensitive member cleaner 6. Transfer residual toner remaining on the intermediate transfer belt 51 is scraped off and collected by an intermediate transfer belt cleaner 55. The fixing device 7 fixes the toner images transferred to the sheet P to the transfer medium P by a pressure and a temperature, forming the color images on the sheet P.

Based on the above arrangement, each adjustment value described above will be explained briefly.

•Curl Correction

A setting value is made small in accordance with a height difference between the center and each edge of a curled sheet. For example, if the height difference between the center and each edge of the sheet is 3 mm or more, a numerical value is decreased by three levels as compared with a current setting value.

•Adjustment of Image Position

If the position of a printed image is shifted with respect to a paper surface, the shift is confirmed in a test page, and a correction value for it is input.

•Adjustment of Secondary Transfer Voltage

A voltage applied to the secondary transfer rollers 56 and 57 is adjusted. As compared with a case in which an image is output to a standard sheet, a parameter is adjusted onto a positive side when the image becomes light or is distorted, and the parameter is adjusted onto a negative side when a white spot appears in a low-density portion, or a white spot appears in a solid part of a high-density portion.

•Adjustment of Secondary Transfer Electric-Charge Removing Bias

If a printed image is distorted, or paper jam occurs immediately after a transfer unit, excessive static electricity may remain in the intermediate transfer belt 51. In this case, a voltage value (electric-charge removing bias) for removing the static electricity remaining in the intermediate transfer belt 51 is adjusted in a [−] direction.

•Adjustment of Glossiness/Black Grade

When plain paper, coated paper, or the like is used, glossiness of an output image is adjusted by adjusting the temperature of the fixing device 7. [+] is pressed when glossiness is to be increased with respect to the coated paper or the like, and [−] is pressed when glossiness is to be decreased. In addition, [+] is pressed when the grade of a clock is to be increased (graininess is to be removed) with respect to the plain paper or the like.

•Change in Saddle Stitching Position

If a difference occurs between a saddle stitching position and the center of a sheet in a finisher 106, the saddle stitching position of a registered setting sheet is changed.

•Adjustment of Saddle Stitch Folding Position

If a folding position is shifted from the center of a sheet although the sheet is saddle stitched at its center, the folding position of a registered setting sheet is changed.

•Adjustment of Saddle Folding Position

A saddle folding position in the finisher 106 is shifted from the center of a sheet, the saddle folding position of a registered setting sheet is changed.

•Adjustment of Primary Transfer Voltage

A voltage applied to the primary transfer rollers 53 is adjusted. If a wide sheet is used after printing on sheets with a small width in a large amount, an image may become light in a portion outside the width of the previously used sheets. In this case, a primary transfer voltage of a registered setting sheet is changed.

•Adjustment of Secondary Transfer Voltage at Leading Edge

If an image in a portion of about 40 mm from the leading edge of a sheet is lighter or darker than those in other portions, a secondary transfer voltage (a voltage when a toner image is transferred to a sheet) at the leading edge of a registered setting sheet is changed.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-256767, filed Dec. 28, 2016, which is hereby incorporated by reference herein in its entirety.

What is claimed is:

1. A system that has a storage storing setting parameters used for a printing process, the system comprising:

a user interface that receives a setting parameter used for the printing process, wherein the user interface is further operable to select a plurality of types of sheet; and a controller that stores, in the storage, the setting parameter received by the user interface as a setting parameter for each of the plurality of types of sheet selected by the user interface in a case where the user interface receives a single predetermined instruction in a state that the plurality of types of sheet have been selected by the user interface and the setting parameter has been received by the user interface.

2. The system according to claim 1, further comprising a display, wherein the controller causes the display of the system to display candidates of sheets, wherein the user interface is operable to select the plurality of types of sheet from the displayed candidates of sheets.

3. The system according to claim 2, wherein the candidates of sheets are changed in accordance with having the setting parameter received by the user interface.

4. The system according to claim 2, wherein the controller causes the display of the system to display candidates of sheets to which the setting parameter received by the user interface is able to be applied and not to display sheets to which the setting parameter received by the user interface is not able to be applied as candidates of sheets.

5. The system according to claim 1, wherein the user interface is able to select the plurality of types of sheet after the user interface receives the setting parameter.

6. The system according to claim 1, wherein the setting parameter is a setting parameter of a secondary transfer voltage.

7. The system according to claim 1, wherein the setting parameter is a setting parameter of an image printing position.

8. The system according to claim 1, wherein the setting parameter is a setting parameter of curl correction.

9. The system according to claim 1, wherein the setting parameter is a setting parameter of a saddle folding position.

10. The system according to claim 1, further comprising a printing apparatus that performs the printing process.

11. The system according to claim 1, wherein the user is interface is further operable to select sheet names of the plurality of types of sheet.

12. The system according to claim 1, further comprising a display, wherein the controller causes the display of the system to display a first screen receiving the setting parameter used for the printing process, wherein the user interface is operable to receive the setting parameter via the displayed first screen, wherein the controller causes the display of the system to display a second screen including candidates of sheets, and wherein the user interface is operable to select the plurality of types of sheet from the candidates of sheets included in in the displayed second screen.

13. A method of controlling a system having a storage storing setting parameters used for a printing process and a user interface, the method comprising:

receiving a setting parameter used for the printing process via the user interface;

selecting a plurality of types of sheet via the user interface; and storing, in the storage, the received setting parameter as a setting parameter for each of the selected plurality of types of sheet in a case where a single predetermined instruction is received in a state that the plurality of types of sheet have been selected and the setting parameter has been received.

14. The method according to claim 13, further comprising:

displaying a first screen receiving the setting parameter used for the printing process; and displaying a second screen including candidates of sheets, wherein the setting parameter is received via the displayed first screen, and wherein the plurality of types of sheet are selected from the candidates of sheets included in in the displayed second screen.

15. A non-transitory computer-readable storage medium storing a program for causing a processor to execute a method of controlling a system having a storage storing setting parameters used for a printing process and a user interface, the method comprising:

receiving a setting parameter used for the printing process via the user interface;

selecting a plurality of types of sheet via the user interface; and storing, in the storage, the received setting parameter as a setting parameter for each of the selected plurality of types of sheet in a case where a single predetermined instruction is received in a state that the plurality of types of sheet have been selected and the setting parameter has been received.

16. The non-transitory computer-readable storage medium according to claim 15, the method further comprising:

displaying a first screen receiving the setting parameter used for the printing process; and displaying a second screen including candidates of sheets, wherein the setting parameter is received via the displayed first screen, and wherein the plurality of types of sheet are selected from the candidates of sheets included in in the displayed second screen.

* * * * *